US007033009B2

(12) United States Patent
Shinada et al.

(10) Patent No.: US 7,033,009 B2
(45) Date of Patent: Apr. 25, 2006

(54) INK CARTRIDGE, INK-JET TYPE PRINTING APPARATUS USING THE SAME, AND INK CARTRIDGE CHANGE CONTROL METHOD IN THE APPARATUS

(75) Inventors: Satoshi Shinada, Nagano-ken (JP); Takahiro Naka, Nagano-ken (JP); Yusuke Torigoe, Nagano-ken (JP); Yuki Togawa, Nagano-ken (JP); Satoru Orii, Nagano-ken (JP); Hikonosuke Uwai, Nagano-ken (JP); Toshio Kumagai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/372,837

(22) Filed: Feb. 26, 2003

(65) Prior Publication Data

US 2003/0137568 A1 Jul. 24, 2003

Related U.S. Application Data

(62) Division of application No. 09/787,123, filed as application No. PCT/JP00/04733 on Jul. 14, 2000, now Pat. No. 6,547,363.

(30) Foreign Application Priority Data

Jul. 14, 1999 (JP) ..... 11-199863
Jan. 28, 2000 (JP) ..... 2000-024742
Apr. 17, 2000 (JP) ..... 2000-115210

(51) Int. Cl.
*B41J 2/175* (2006.01)

(52) U.S. Cl. ..... 347/86

(58) Field of Classification Search ..... 347/19, 347/86

See application file for complete search history.

(56) References Cited

U.S. PATENT DOCUMENTS 5,365,312 A 11/1994 Hillmann et al.
5,506,611 A 4/1996 Ujita et al.
5,610,635 A * 3/1997 Murray et al. ..... 347/7
5,638,097 A 6/1997 Takayanagi et al.
5,646,660 A 7/1997 Murray
6,019,461 A * 2/2000 Yoshimura et al. ..... 347/19
6,126,265 A 10/2000 Childers et al.
6,158,850 A 12/2000 Cook
6,168,262 B1 1/2001 Clark et al.

(Continued)

FOREIGN PATENT DOCUMENTS

DE 3405164 A 8/1985

(Continued)

*Primary Examiner*—Stephen Meier
*Assistant Examiner*—Julian D. Huffman
(74) *Attorney, Agent, or Firm*—Sughrue Mion, PLLC

(57) ABSTRACT

An ink cartridge which has an IC memory for holding information about the cartridge. At the time the ink cartridge is to be installed in a printing apparatus, its insertion is inhibited at a position before installation by a lock mechanism. In this state, the information in the IC memory is read out via a first electrode terminal located on the cartridge side and connected to the IC memory and the propriety of the installation of the ink cartridge to the apparatus is determined. When the ink cartridge is determined to be appropriate, the lock mechanism is unlocked and the ink cartridge can be installed into the printing apparatus. When the ink cartridge is installed in the printing apparatus, data is exchanged between the printing apparatus and the IC memory via a second electrode terminal connected to the IC memory.

8 Claims, 25 Drawing Sheets

U.S. PATENT DOCUMENTS

| | | | |
|---|---|---|---|
| 6,293,662 | B1 | 9/2001 | Shihoh et al. |
| 6,312,106 | B1 | 11/2001 | Walker |
| 6,398,335 | B1 | 6/2002 | Benjamin |

FOREIGN PATENT DOCUMENTS

| | | | | | |
|---|---|---|---|---|---|
| EP | 0 720 916 | A2 | | 7/1996 | |
| EP | 0 878 307 | A2 | | 11/1998 | |
| FR | 2 744 391 | A1 | | 8/1997 | |
| JP | 62-184856 | | | 8/1987 | |
| JP | 05-261935 | A | | 10/1993 | |
| JP | 06 262771 | A | | 9/1994 | |
| JP | 08-230213 | A | | 9/1996 | |
| JP | 08310007 | A | * | 11/1996 | ..... 347/19 |
| JP | 10-286976 | | | 10/1998 | |
| JP | 10-323995 | A | | 12/1998 | |
| WO | WO 96/04141 | A1 | | 2/1996 | |
| WO | WO 98/04414 | A1 | | 2/1998 | |

* cited by examiner

INK CARTRIDGE, INK-JET TYPE PRINTING APPARATUS USING THE SAME, AND INK CARTRIDGE CHANGE CONTROL METHOD IN THE APPARATUS

CROSS-REFERENCE TO RELATED APPLICATIONS

This is a divisional of application Ser. No. 09/787,123 filed Mar. 14, 2001 now U.S. Pat. No. 6,547,363, which is a 371 of PCT/JP00/04733, filed Jul. 14, 2000, the disclosure of which is incorporated herein by reference.

BACKGROUND OF THE INVENTION

The present invention relates to an ink cartridge having a storage medium capable of storing information about an ink cartridge and an ink-jet type printing apparatus capable of preventing erroneous installation of an ink cartridge. The invention relates to an ink cartridge change control scheme using cartridge information from a storage medium provided on an ink cartridge.

BACKGROUND ART

An ink-jet type printing apparatus has an ink-jet type printing head, which is supplied with ink from an ink cartridge, and a paper feeder, which moves printing paper relative to the printing head. The apparatus prints by discharging ink droplets on the printing paper while moving the printing head based on print data.

Further, a printing head capable of discharging ink of, for example, black, yellow, cyan and magenta is mounted on a carriage. This permits text printing with the black ink and full color printing by changing the discharge ratio of the individual inks. The ink cartridge that feeds ink to the printing head is mounted on, for example, the carriage in a detachable manner.

Recently, demand for higher printing quality has increased, and various inks have been provided to meet the demand. When various inks are provided, there is a possibility that a cartridge retaining the wrong kind of ink will be incorrectly installed. When a cartridge for yellow ink is attached to a holder where a cartridge for black ink, for example, has been attached, the colors will mix, which will significantly degrade the printing quality. In the worst case, the different inks may react with each other and solidify. In most of such cases, recovery of the printing functions becomes impossible.

Various solutions to this problem have been suggested, such as formation of a pattern for preventing erroneous insertion on the case of each ink cartridge by means of, for example, undulation. However, mechanical formation of patterns, which physically differ from one another, to prevent incorrect cartridge installation, on the cases of the individual ink cartridges not only increases the cost of production but also creates problems when recycling the cartridges. Further, since the patterns for preventing erroneous insertion are limited, if the number of types of ink continues to increase, there will not be enough patterns.

Depending on the situation, ink that has been in stock over a long period of time and is beyond its expiration date may be used, and this problem cannot be avoided by conventional cartridges and printing apparatuses. Further, when photo-ink is to be used in place of normal ink, for example, it is desirable to install a photo-ink cartridge after the normal ink is discharged completely from the ink flow passage in the printing head.

In an existing printing apparatus, however, when an ink cartridge is installed, a hollow ink feeding needle located on the printing apparatus is immediately connected to the ink feeding port of the cartridge. It is therefore difficult to discharge the ink that exists in the ink flow passage.

To prevent vaporization of ink solvent, the cartridge ink feeding port is sealed with an ink protection film at the time of shipment by the maker, and the entire cartridge is packaged under reduced pressure in packaging material.

When a cartridge is attached to a cartridge holder of a printing apparatus, the ink feeding needles provided on the cartridge holder side break the ink protection film, and the ink feeding port of the cartridge is connected to the ink feeding needles at the same time, so that ink can be fed to the printing apparatus.

When a cartridge is erroneously attached to another holder, therefore, the ink protection film adhered to the ink feeding port has already been broken, making the viscosity of the ink higher. Therefore, removing a cartridge and retaining it for later use causes printing problems.

The present invention has been devised in view of the situation described above and its primary objective is to provide an ink cartridge capable of preventing the wrong ink from being fed to a printing apparatus. In this case, the invention provides an ink cartridge capable of determining the propriety of the installation of the ink cartridge without breaking the ink protection film that seals the ink feeding port of the ink cartridge.

It is another objective of the present invention to provide an ink cartridge and ink-jet type printing apparatus, that recognizes the installation of a wrong ink cartridge and prevents the erroneous installation by using an ink cartridge that has a storage medium capable of storing information about the cartridge before the ink feeding needles of the printing apparatus break the ink protection film of the cartridge.

It is a further objective of the invention to provide an ink-jet type printing apparatus and an ink cartridge change control method in the apparatus that automatically perform ink discharge and ink change, when an ink cartridge of a different characteristic is selected.

SUMMARY OF THE INVENTION

An ink cartridge according to a first aspect of the present invention has a storage medium for holding information about the ink cartridge, and the ink cartridge is moved to a second position where ink can be supplied to a printing apparatus through a first position before installation at the time it is installed in the printing apparatus. With at least the ink cartridge inserted at the first position, the information in the storage medium provided in the cartridge is transmitted to the printing apparatus to determine the propriety of installation of the ink cartridge.

This structure of the ink cartridge makes it possible to recognize the installation of an incorrect ink cartridge before the ink feeding needles of the printing apparatus break the ink protection film of the cartridge. This prevents erroneous installation of an ink cartridge.

An ink-jet type printing apparatus according to the first aspect of the invention uses the aforementioned ink cartridge and has a cartridge holder in which the ink cartridge is inserted for attachment and ink intake means for receiving ink into the cartridge when coupled to the cartridge with the cartridge attached to the cartridge holder. The ink-jet type printing apparatus includes readout means for reading the information about the ink cartridge from the storage medium by accessing the storage medium of the ink cartridge when the cartridge is at a first position before attachment of the ink intake means to the ink cartridge and propriety determining means for determining whether or not the ink cartridge is appropriate by referring to the read cartridge information, and the apparatus informs a user of the result of that determination.

The printing apparatus with this structure checks the propriety of the installation of the cartridge to the printing apparatus when the cartridge is at the first position, which is located before the position where the ink intake means of the printing apparatus is to be attached to the ink cartridge. This makes it possible to prevent the improper installation of the ink cartridge before the ink is fed into the printing apparatus.

An ink-jet type printing apparatus according to the second aspect of the invention is constructed such that an ink cartridge having a storage medium capable of storing information about the cartridge is installable in a detachable manner. It includes readout means for reading the information from the storage medium in the installed ink cartridge, information analysis means for analyzing the information about the cartridge read by the readout means and ink intake means driven by a control signal generated by the information analysis means to let ink out when connected to the ink cartridge.

The printing apparatus with this structure reads information from the storage medium of the installed ink cartridge and checks the propriety of the installation of the cartridge. When it is determined that the installed ink cartridge is appropriate, the ink intake means is driven to be connected to the ink cartridge so that the ink is led out. Even if an improper cartridge is installed, therefore, the ink intake means is not driven, making it possible to prevent the ink from being fed into the printing apparatus from the improper cartridge.

An ink cartridge change control method in the ink-jet type printing apparatus according to the second aspect of the invention sequentially executes an information readout step of reading the cartridge information from the storage medium in the installed ink cartridge; a cartridge information analysis step of analyzing the cartridge information read in the information readout step; and an ink-intake-means drive step of driving ink intake means for taking ink out from the ink cartridge upon reception of a control signal generated as a result of analysis in the cartridge information analysis step.

In this case, an ink drawing/discharging step of drawing and discharging ink from the printing head by applying negative pressure to capping means is executed based on the result of analysis in the cartridge information analysis step, and the ink-intake-means drive step is executed after the ink drawing/discharging step.

The use of such change steps permits the ink to be changed without mixing inks in the printing apparatus and ensures selective use of various kinds of inks in accordance with the diversification of inks.

DETAILED DESCRIPTION OF THE PREFERRED EMBODIMENTS

Figure 1:
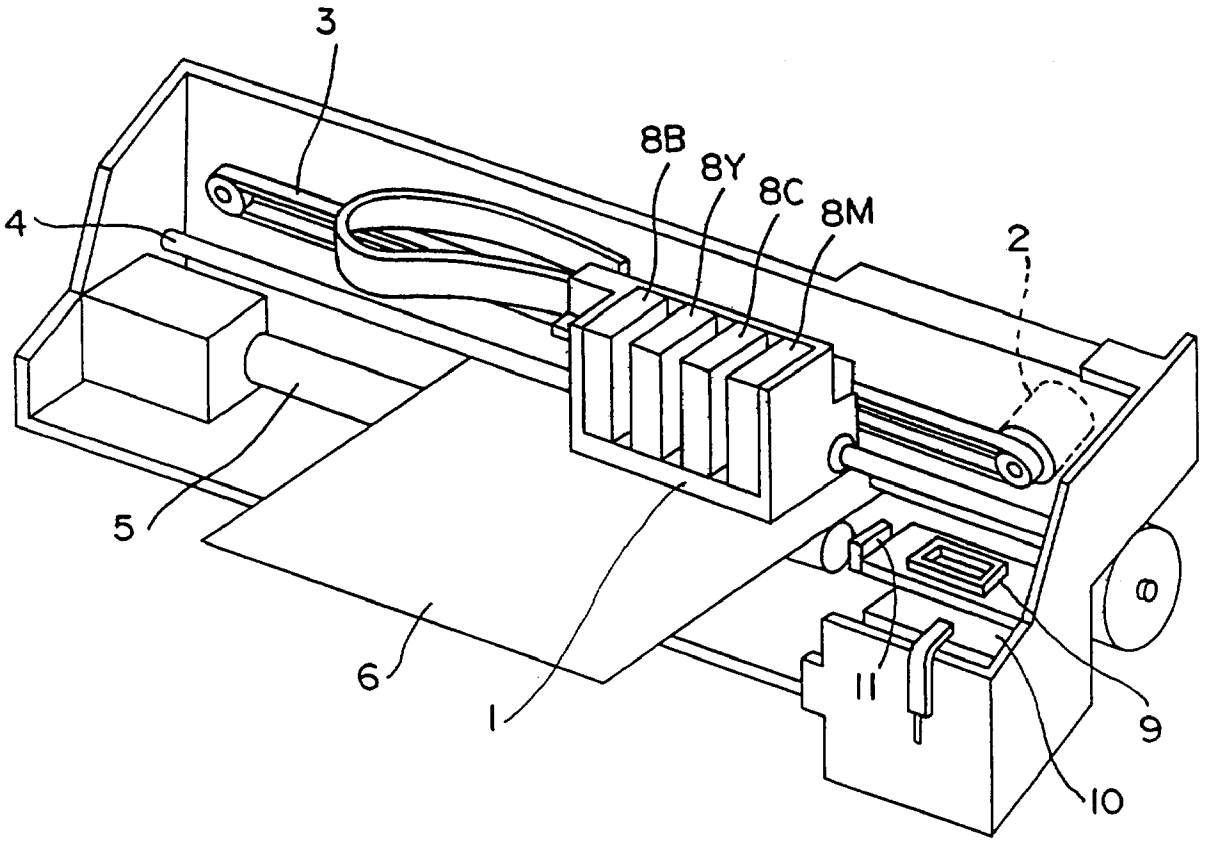
FIG. 1 is a perspective view showing the fundamental structure of the body of an ink-jet type printing apparatus according to the present invention.

FIG. 1 shows the fundamental structure of an ink-jet type printing apparatus according to the present invention in a perspective view. In FIG. 1, the symbol "1" refers to a carriage that is constructed to be guided by a guide rod 4 to move back and forth in the axial direction of a platen 5 which a timing belt 3, which is driven by a carriage motor 2.

A sheet of printing paper 6 is placed in the scan area where the carriage 1 scans. The printing paper 6 is designed to be fed perpendicularly to the scan direction of the carriage 1. A printing head 7, to be discussed later, is mounted at the bottom surface of the carriage 1, which faces the printing paper 6. Ink cartridges 8B, 8Y, 8C and 8M, in which individual inks of black, yellow, cyan and magenta are stored and which feed the inks to the printing head, are placed above the printing head 7, in a detachable manner, in cartridge holders, which are formed on the upper portion of the carriage 1 and will be discussed later.

A capping device 9 is located at a home position, which is a non-print area. The capping device 9 is constructed to seal the nozzle of the printing head mounted on the carriage 1 in accordance with the movement of the carriage 1 when the carriage 1 is moved to the home position.

The capping device 9 is designed to move downward to break the seal of the printing head as the carriage 1 moves toward the print area. Located below the capping device 9 is a suction pump 10 for applying negative pressure to the internal space of the capping device 9.

The capping device 9 serves as a lid that prevents the nozzle opening of the printing head from drying when the printing apparatus is not operating and also serves as an ink receiver in a flashing operation mode, in which ink droplets are discharged by applying a drive signal unrelated to printing to the printing head. Further, the capping device functions as a cleaning device for drawing and removing ink from the printing head by applying the negative pressure from the suction pump 10 to the printing head.

A wiping member 11, which is an elastic plate made of material such as rubber, is located adjacent to the print area side of the capping device 9. The wiping member 11 is designed to wipe the nozzle of the printing head clean as needed when the carriage 1 moves back and forth toward the capping device 9.

Figure 2:
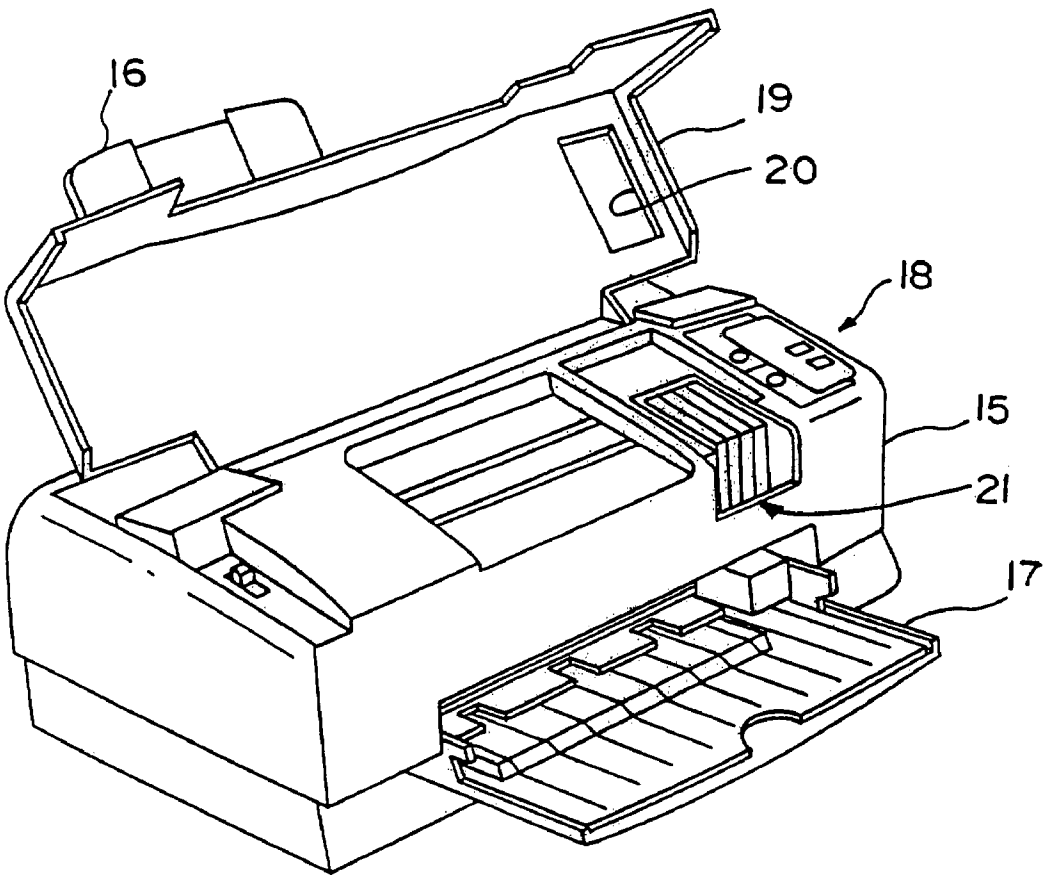
FIG. 2 is a perspective view showing one example of an outer case in which the printing apparatus shown in FIG. 1 is housed.

The body of the printing apparatus, which has the above-described structure, is retained in an outer case having, for example, the form shown in FIG. 2. The outer case 15 has a paper feed tray 16 located at its back and a paper discharge tray 17 at its front. Located at the upper right corner surface of the outer case 15 is an operational panel 18 having buttons, which include a cleaning instruction switch, a cartridge change switch and a power switch, which will be discussed later.

A lid (hereinafter also called "printer cover") 19, which covers the top portion of the operational panel 18, is attached to the front side of the apparatus by a hinge (not shown) to permit the lid to open and close. A window hole 20 is formed in this printer cover 19 so that the individual switches of the operational panel 18 are exposed when the cover 19 is closed.

With the printer cover 19 open, an ink cartridge change window 21 is exposed. The ink cartridge change window 21 is formed at a position different from the home position at which the capping device 9 is located. When an ink cartridge is changed, for example, the carriage is controlled to have to the ink cartridge change window 21.

This control step avoids a problem that, when ink cartridge is changed, for example, the stress caused by removing and inserting the ink cartridge acts on the capping device, thus damaging the elevating mechanism of the capping device. This step also avoids the problem that, when an ink cartridge is changed when it is not empty, for example, a variation in pressure in the sealed capping device breaks the meniscus of the ink that is formed at the nozzle opening of the printing head, thus resulting in poor printing.

FIGS. 3 through 21 illustrate an ink cartridge according to the first aspect of the invention that is adapted to the printing apparatus with the above-described structure and an ink-jet type printing apparatus that uses this cartridge. The ink cartridge and printing apparatus according to the first aspect of the invention are characterized in that immediately before an ink cartridge is installed in the printing apparatus, information about the cartridge is read from an information storage medium attached to the cartridge to determine the propriety of the installation of the cartridge.

Figure 3:
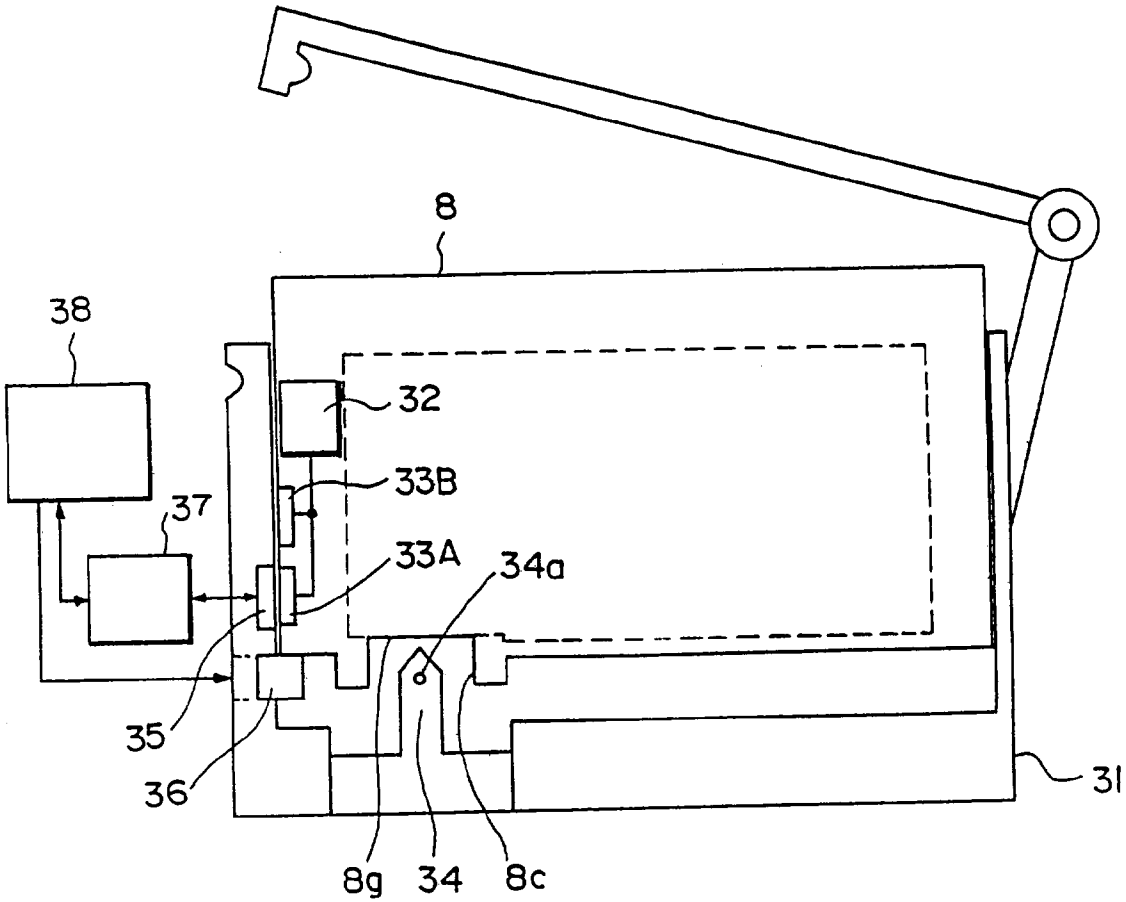
FIG. 3 is an exemplary diagram according to a first embodiment illustrating a state immediately before an ink cartridge is attached to a cartridge holder formed on a carriage.
Figure 4:
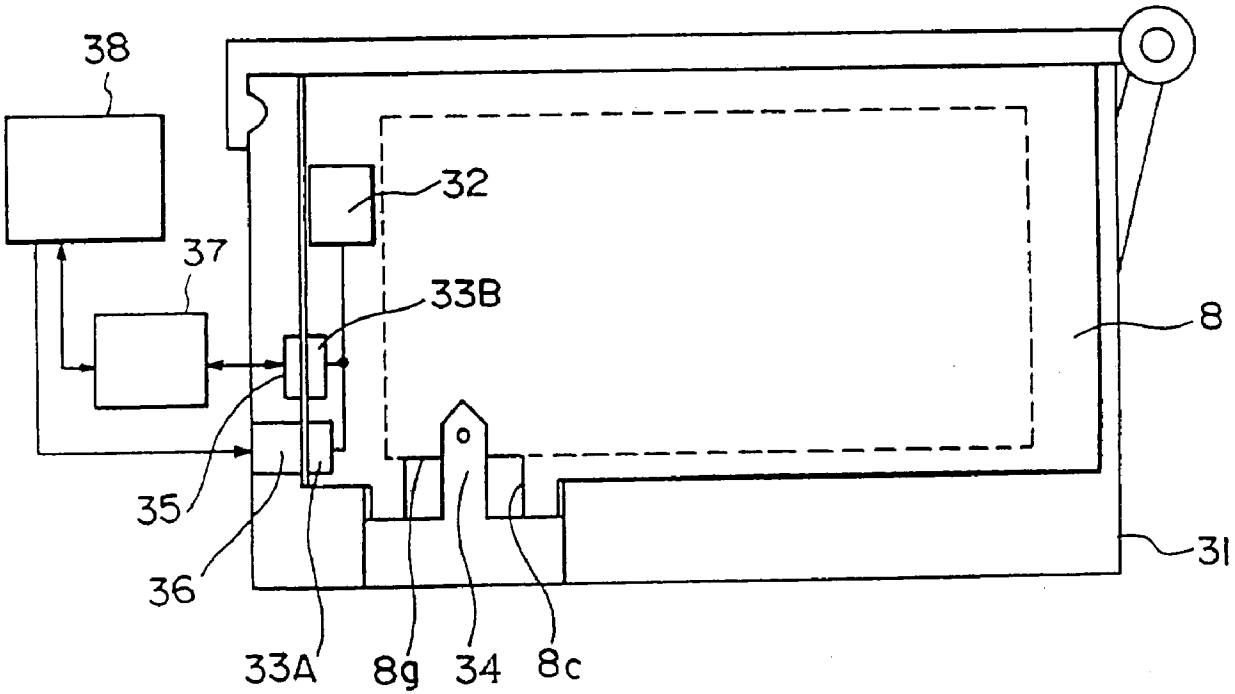
FIG. 4 is an exemplary diagram illustrating a state in which the installation of the ink cartridge has been completed from the state shown in FIG. 3.

FIG. 3 exemplarily shows the state immediately before an ink cartridge is attached to the cartridge holder formed on the carriage 1 of the printing apparatus, and FIG. 4 exemplarily shows the state after the ink cartridge is attached to the cartridge holder.

As shown in FIG. 1, a plurality of ink cartridges (hereinafter also called simply "cartridges") 8B, 8Y, 8C and 8M are attached in a parallel relationship to the cartridge holder (hereinafter also called simply the "holder") arranged on the carriage 1. In the example shown in FIG. 3, one of the cartridges is shown, and this cartridge is typical and is denoted by symbol "8".

The cartridge has an ink retaining chamber formed, in a well known manner, and ink fills a porous member, such as urethane, and is sealed in the ink retaining chamber. Formed in the bottom portion of the cartridge 8 is an ink feeding port 8*c* from which the ink can be fed out. An ink protection film 8*g* for preventing the vaporization of the ink solvent is adhered to the ink feeding port 8*c* to seal the ink feeding port 8*c*.

This cartridge 8 is provided with an IC memory 32 or a non-volatile storage medium, such as an EEPROM, which electrically retains information for controlling the printing apparatus. The information held in the IC memory 32 includes information used by the printing apparatus to prevent the installation of an incorrect cartridge and information for controlling the printing operation to ensure adequate printing.

More specifically, the information includes information on all the types of printing apparatuses in which the cartridge 8 can be used, identification information (product name, production number) of the cartridge 8, color information of the sealed ink, information about the type of the ink (dye, pigments, etc.), information about the validity period (or production date) of the ink, information about the remaining amount of the ink in the cartridge and suitable printing conditions (e.g., the voltage applied to the print head and the number of ink discharges from the nozzle) when the cartridge is used.

The cartridge 8 according to this embodiment has a pair of electrode terminals (or electrode terminal groups) 33A and 33B provided as access terminals to the IC memory 32. The access electrode terminals 33A and 33B are located on the outer surface of the cartridge 8 and are arranged in the direction of the insertion of the cartridge 8 into the holder 31 at different positions, or spaced apart in the vertical direction of the diagram.

The first electrode terminal 33A connected to the IC memory 32 is provided at a position to contact a contact terminal (or contact terminal group) 35 located on the inner wall of the holder 31 at a first position before the ink protection film 8*g* is ruptured by ink feeding needle 34, or ink intake means, provided deep in the holder 31, when the cartridge is inserted in the holder 31.

The second electrode terminal 33B connected to the IC memory 32 is located to contact the contact terminal 35 located on the holder 31 when it is at a second position, at which the attachment of the cartridge 8 to the holder 31 is completed, i.e., when the ink feeding needle 34, or ink intake means, rupture the ink protection film 8*g* so that the ink is supplied to the printing apparatus, as shown in FIG. 4.

With this structure, when the cartridge 8 is installed, the printing apparatus can access information through the electrode terminal 33A to the IC memory 32 on the cartridge 8 to check the propriety of the installation of the ink cartridge 8 at the first position, before the ink feeding needle 34 contacts the ink protection film 8*g* of the cartridge 8.

While the cartridge 8 is entering the second position from the first position, the ink protection film 8*g* provided on the cartridge 8 is ruptured by the ink feeding needle 34. When the cartridge 8 has reached the second position, the ink is fed to the head of the printing apparatus via ink feeding holes 34*a* provided near the tips of the ink feeding needle 34. In this state, the IC memory 32 can be accessed through the electrode terminal 33B connected to the IC memory 32, and printing can be performed based on the aforementioned suitable printing conditions.

Provided on the holder 31 is a lock mechanism 36, which constitutes insertion inhibition means, that can temporarily inhibit further insertion of the cartridge 8 in the first position. When the cartridge 8 is locked at the first position by the lock mechanism 36, a read signal from the IC memory 32 is sent to a CPU 38 in the printing apparatus via read/write means 37 connected to the terminal 35.

Then, the CPU 38 determines the propriety of the installation of the cartridge. When it is determined that the cartridge is correct, a command signal from the CPU 38 withdraws the lock mechanism 36. As a result, the cartridge can be moved to the second position where ink can be fed as shown in FIG. 4.

Figure 5:
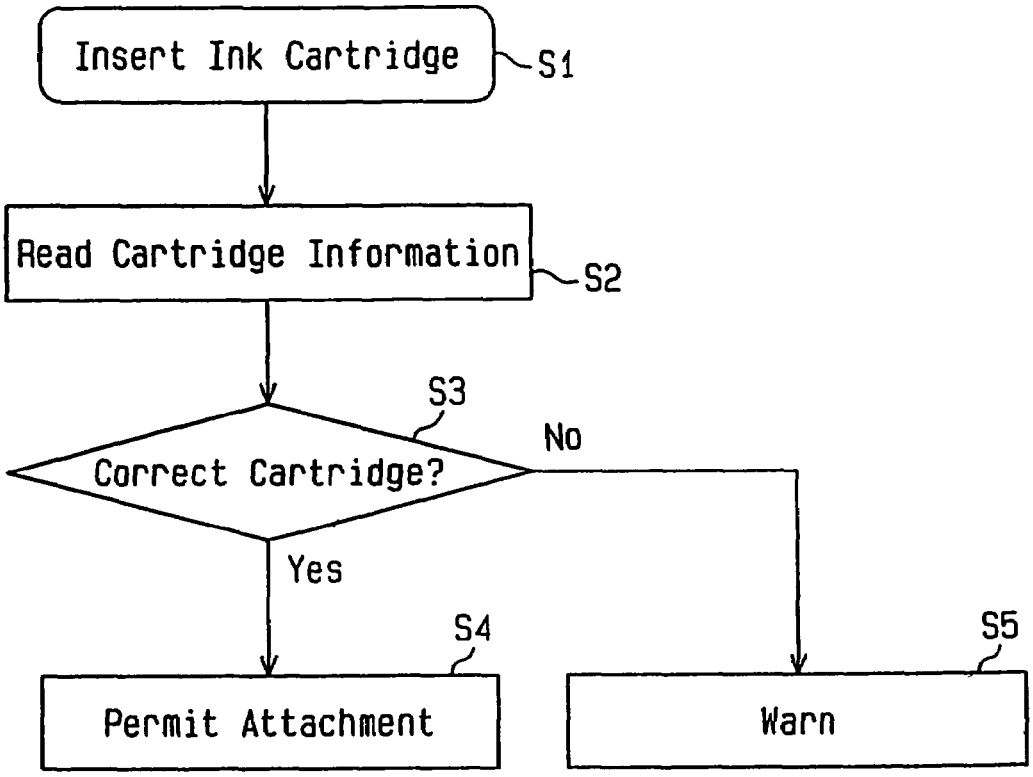
FIG. 5 is a flowchart illustrating a cartridge determining routine, which is executed when the state shifts to that shown in FIG. 4 from that shown in FIG. 3.

FIG. 5 illustrates a decision operation that the printing apparatus performs when the cartridge 8 is attached to the holder 31. First, the lock mechanism 36 in the holder 31 is in a locked state where it protrudes into the inner wall of the holder 31 after the previous cartridge has been pulled out of the holder 31 and before the next cartridge 8 is inserted. When the cartridge 8 is inserted in this situation (step S1), the lock mechanism 36 locks the cartridge 8 at a position where the ink protection film 8*g* located at the ink feeding port 8 of the cartridge does not reach the ink feeding needle 34.

At that position, the electrode terminal 33A located on the cartridge 8 contacts the contact terminal 35 located on the holder 31 so that the IC memory 32 and the read/write means 37 are electrically connected together.

The CPU 38 in the printing apparatus reads information retained in the IC memory 32 through the read/write means 37, such as information on all the types of printing apparatuses in which the cartridge can be used, ID information about the cartridge, the color, type, validity period and the remaining amount of ink, (step S2) and the CPU 38 checks whether the inserted cartridge is correct (step S3).

The cartridge is determined to be correct, for example, when the type of the printing apparatus matches the cartridge type, when the ink color and the type are correct, when and the validity period of the ink has not expired, and when the remaining amount of ink is equal to or greater than a specified value. When the apparatus determines that the cartridge is correct (Yes) in the step S3, the lock mechanism 36 is retracted to a position (inside the wall of the holder 31) where further insertion of the cartridge 8 is permitted and a user is allowed to attach the cartridge 8 (step S4).

When the attachment of the cartridge is determined to be incorrect (No) in the step S3, the user is informed and an alarm is generated (step S5). Means available for the alarm are generation of a sound, lighting of a lamp or display of a message on the panel.

When the cartridge 8 is attached to the holder 31 based on step S4, the IC memory 32 of the cartridge 8 is electrically connected to the read/write means 37 of the printing apparatus via the electrode terminal 33B and the contact terminal 35. The CPU 38 of the printing apparatus reads information held in the IC memory 32 via the read/write means 37, such as the remaining amount of ink and suitable printing conditions, to prepare for execution of a printing process.

The CPU 38 in the printing apparatus can write information, which varies in accordance with the printing process, e.g., the remaining amount of the ink, in the IC memory 32 as needed in accordance with the execution of printing. When the information cannot be read from the IC memory 32, it may be considered that the cartridge 8 has not been inserted yet to the second position described above and the user may be informed of such.

According to this embodiment, the insertion of the cartridge 8 into the holder 31 is inhibited at the position before the ink feeding needle enters the cartridge 8 and it is checked there whether or not the installation of the cartridge 8 is correct. Accordingly, it is possible to reliably check whether the cartridge is suitable for attachment before the ink protection film 8*g* provided on the cartridge 8 is ruptured by the ink feeding needle 34.

In the propriety checking, the printing apparatus can receive information that the user cannot know from the shape of the cartridge 8, such as the remaining amount of ink and the validity period of the ink. This can inhibit the installation of the inserted cartridge and can reliably prevent the wrong ink from being fed to the printing apparatus.

Figure 6:
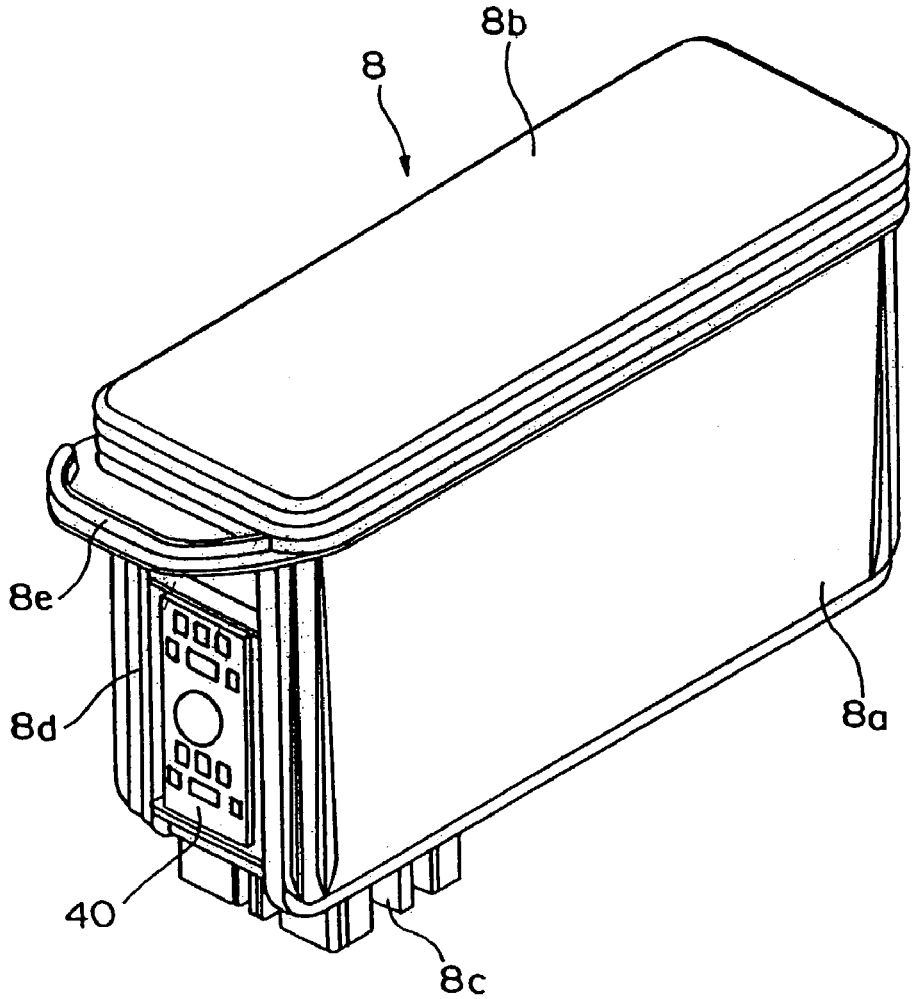
FIG. 6 is a perspective view showing the external structure of an ink cartridge that is suitable for the structure shown in FIGS. 3 and 4.

FIG. 6 shows an external structure of the ink cartridge that can suitably be used in the printing apparatus with the above-described structure. The cartridge 8 has an outer frame formed by a lid 8*b* attached in air-tight manner to the top of a container 8*a* formed parallelepiped. An ink feeding port 8*c* is formed in the bottom of the container 8*a*, to face the ink feeding needle 34 when attached to the holder 31, and an overhang portion 8*e*, which engages with the projection of a lever provided on the holder (discussed later), is formed at the upper end of a vertical wall 8*d* on that side of the ink feeding port 8*c*.

Figure 7A:
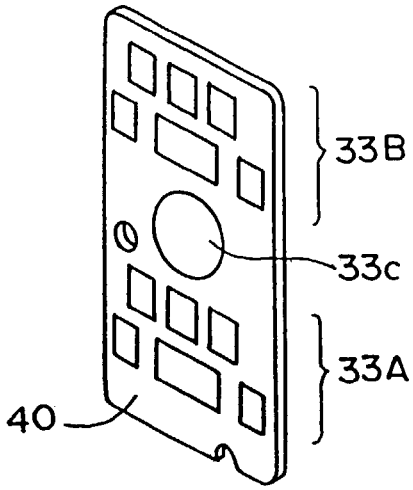
FIG. 7(*a*) and FIG. 7(*b*) are front and rear perspective views, respectively, showing a preferred example of a storage medium mounted on the ink cartridge shown in FIG. 6.
Figure 7B:
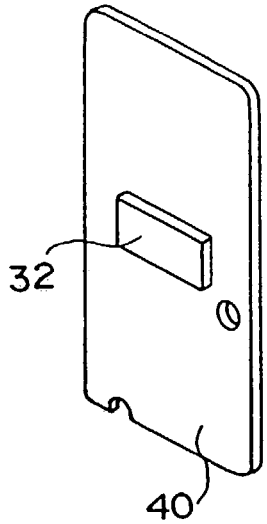

A circuit board 40 is attached to the vertical wall 8*d* on the ink feeding port 8*c* side. The circuit board 40 has a first electrode terminal group 33A and a second electrode terminal group 33B formed as two groups arranged in the insertion direction of the cartridge as shown in FIG. 7(*a*). At the back of the circuit board, the IC memory 32 is attached as shown in FIG. 7(*b*).

In the embodiment shown in FIGS. 7(*a*) and 7(*b*), though not illustrated, parallel signal lines from the IC memory 32 are connected to the first electrode terminal group 33A and the second electrode terminal group 33B. That is, the use of either the first electrode terminal group 33A or the second electrode terminal group 33B can permit exchange of information signals with the IC memory 32. The electrode that is sandwiched between the first electrode terminal group 33A and the second electrode terminal group 33B and is denoted by symbol "33C" is used in checking in the manufacturing process.

Figure 8A:
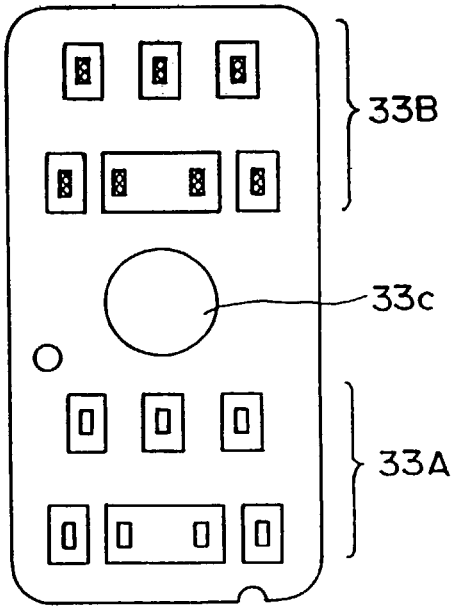
FIG. 8(*a*) and FIG. 8(*b*) are a front view and a side view, respectively, depicting the state of accessing cartridge information in the storage medium shown in FIGS. 7(*a*) and 7(*b*).
Figure 8B:
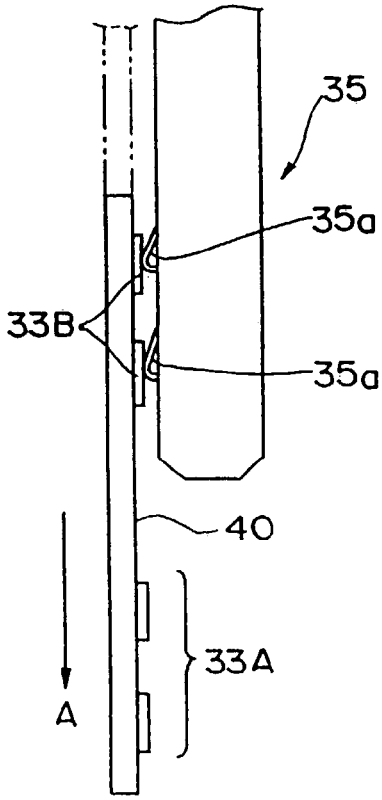

FIG. 8 shows the state where the contact terminal group 35 provided on the inner wall of the holder 31 contacts the first electrode terminal group 33A and the second electrode terminal group 33B formed on the circuit board 40 at the first position and the second position in the step of inserting the cartridge into the holder. Contact forming members 35*a* having elasticity, such as phosphor bronze, are used for the contact terminal group 35 and are arranged in two stages, vertically, along the insertion direction of the cartridge.

When the cartridge is inserted in the holder and reaches the first position, the contact terminal group 35 comes in contact with the first electrode terminal group 33A. This provides electric contact between the IC memory 32 and the read/write means 37 so that a read signal from the IC memory 32 is sent to the CPU 38 in the printing apparatus. At this time, as mentioned above, the CPU 38 in the printing apparatus reads the information held in the IC memory 32 via the read/write means 37 and checks whether the inserted cartridge is suitable for attachment.

When it is determined that the inserted cartridge is suitable for attachment, the attachment of the cartridge is permitted as mentioned above. Accordingly, the cartridge is moved to the second position to be attached. At this time, the circuit board 40 attached to the cartridge relatively moves in the direction of an arrow A, which causes the contact terminal group 35 to contact the second electrode terminal group 33B. The double hatched portions of the second electrode terminal group 33B in FIG. 8(*a*) indicate where the contact terminal group 35 makes contact.

Therefore, the IC memory 32 is in electric contact with the read/write means 37, and the CPU 38 in the printing apparatus can read the remaining amount of ink and suitable printing conditions retained in the IC memory 32 via the read/write means 37 and can prepare for execution of the printing process.

Figure 9:
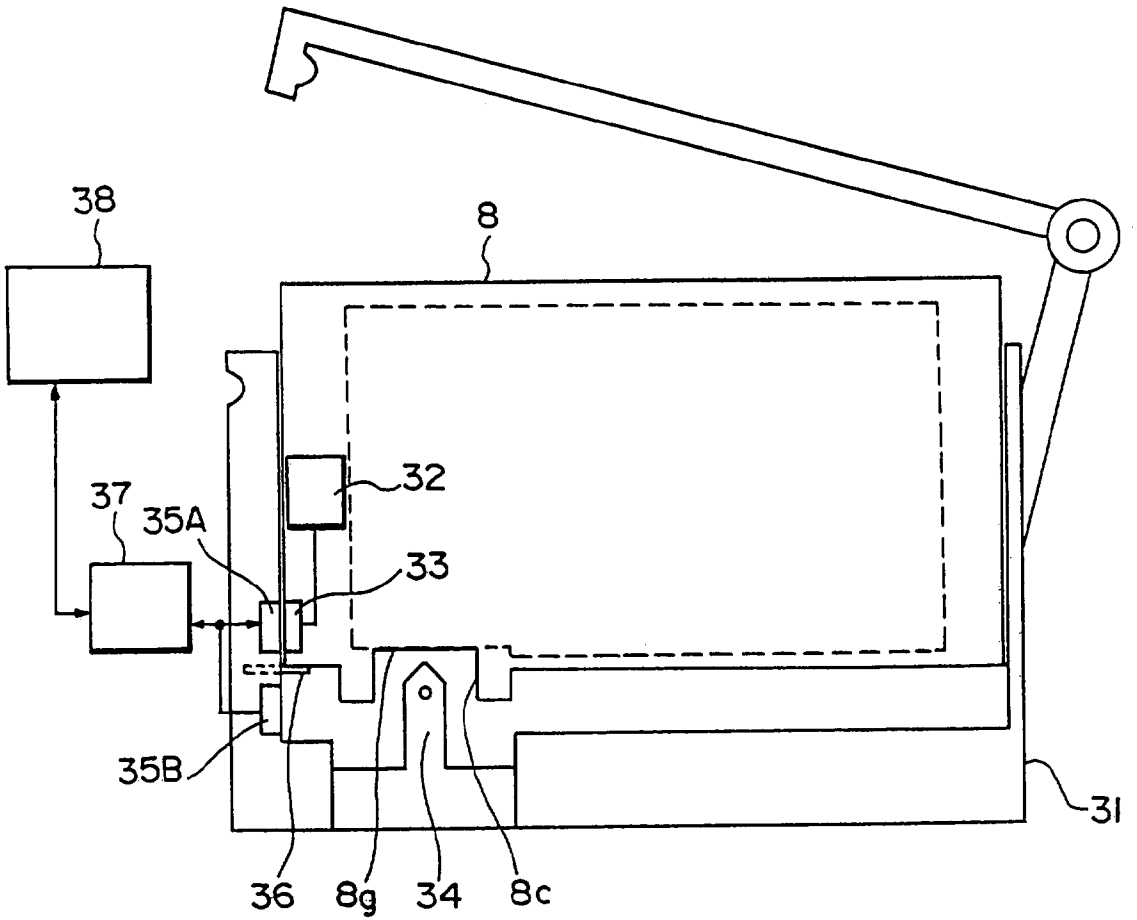
FIG. 9 is an exemplary diagram according to a second embodiment illustrating a state immediately before an ink cartridge is attached to a cartridge holder formed on a carriage.
Figure 10:
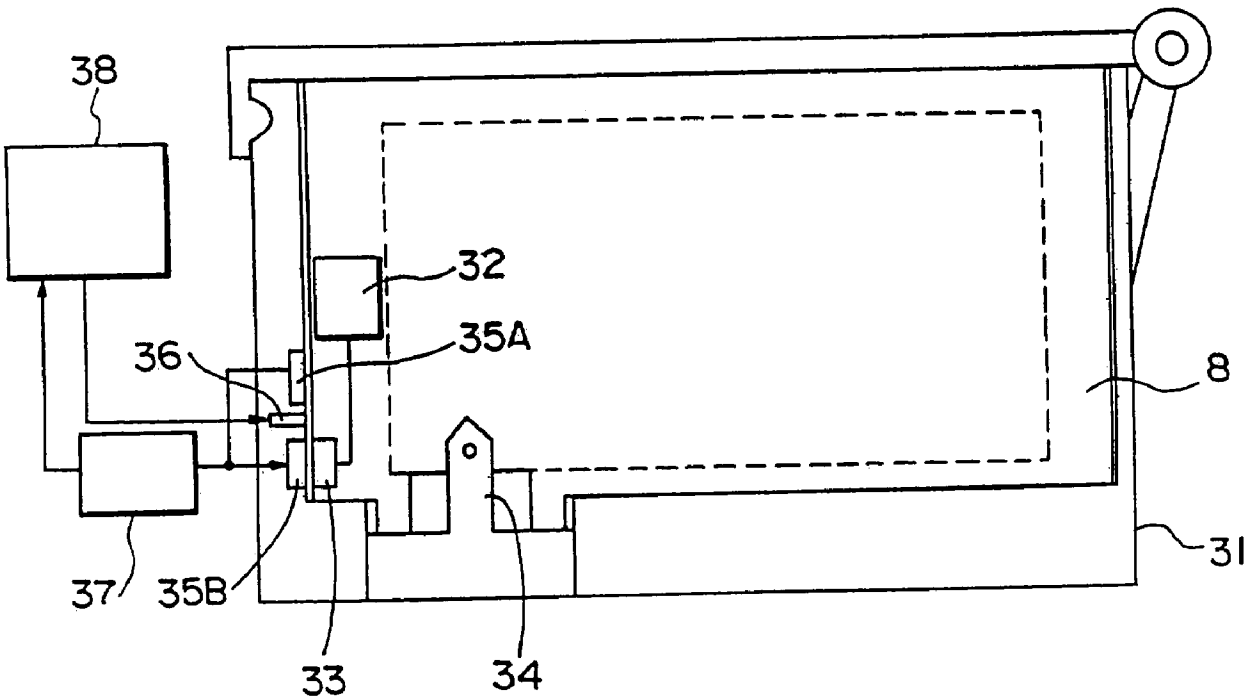
FIG. 10 is an exemplary diagram illustrating a state in which the installation of the ink cartridge has been completed from the state shown in FIG. 9.

FIG. 9 exemplarily shows a state immediately before the ink cartridge is attached to the cartridge holder of the carriage 1 of the printing apparatus according to a second embodiment. FIG. 10 exemplarily illustrates a state after the ink cartridge has been attached to the cartridge holder. In both diagrams, same reference numerals are given to those portions that correspond to the portions of the embodiment shown in FIGS. 3 and 4. The following will explain only the differences.

The cartridge 8 according to this embodiment has one set of electrode terminal 33 for access to the IC memory 32. The holder 31 has two sets of contact terminals 35A and 35B arranged in the vertical direction and connected in a parallel manner to the read/write means 37. The first contact terminal 35A of the holder 31 is located at the position where it contacts the electrode terminal 33 provided on the cartridge 8 when the cartridge 8 is locked at the first position by the lock mechanism 36 as shown in FIG. 9.

The second contact terminal 35B of the holder 31 is located at a position where it contacts the electrode terminal 33 provided on the cartridge 8 when the lock mechanism 36 is released and the cartridge 8 is moved to the second position as shown in FIG. 10.

With this structure, the CPU 38, which is in the printing apparatus, can read information retained in the IC memory 32 via the contact terminal 35A and can check whether the cartridge 8 is correct for attachment while the cartridge 8 is restricted to the first position by the lock mechanism 36. When it is determined that the cartridge is correct for attachment, as shown in FIG. 10, the lock mechanism 36 is retracted to a position where it does not interfere with further insertion of the cartridge 8, thus permitting the attachment of the cartridge 8. When the cartridge 8 is moved to the second position, the CPU 38 reads the suitable printing conditions or the like from the IC memory 32 via the second contact terminal 35B and prepares for execution of the printing process.

Figure 11:
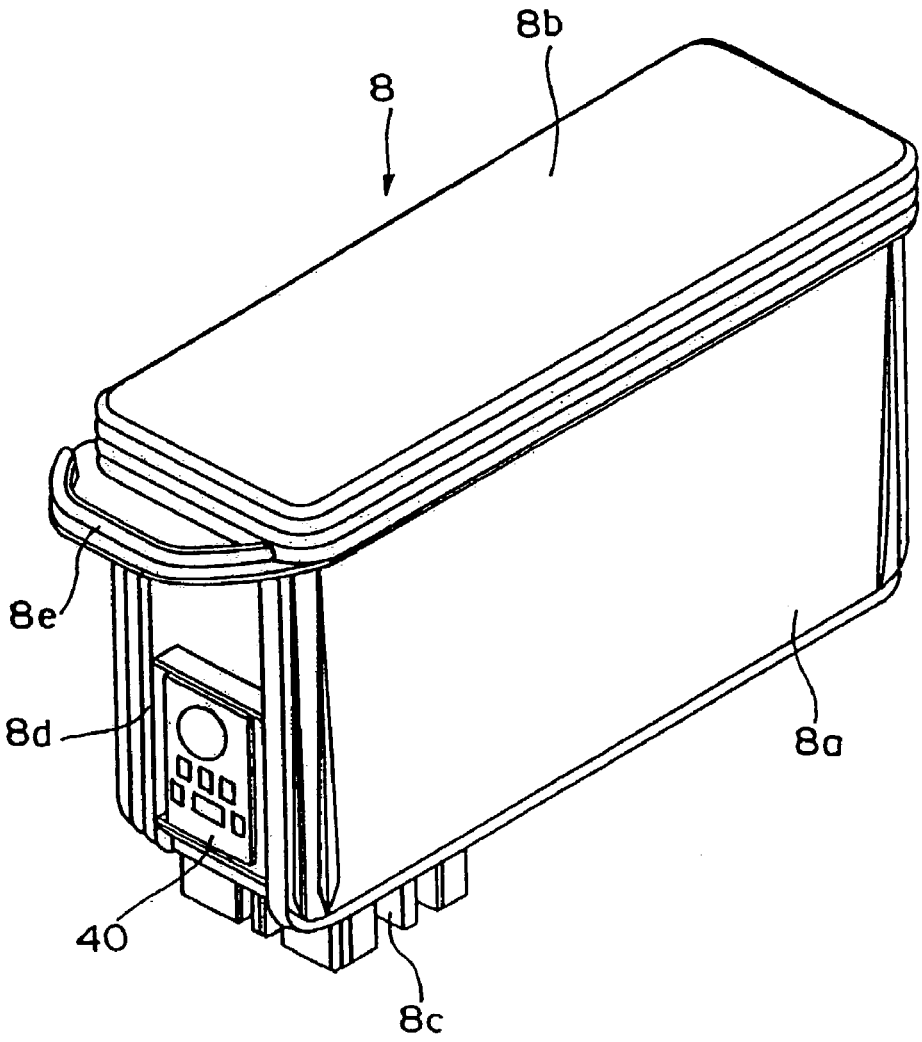
FIG. 11 is a partly enlarged view showing an improved example of the structure shown in FIG. 9.

FIG. 11 shows an outer structure of the ink cartridge that can be used in the printing apparatus with the above-described structure. The basic structure of the ink cartridge shown in FIG. 11 is the same as the structure shown in FIG. 6. The difference lies in the structure of the circuit board 40 provided on the cartridge 8.

Figure 12A:
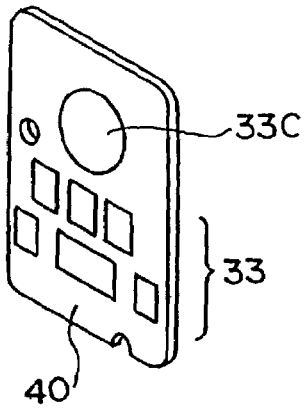
FIG. 12(*a*) and FIG. 12(*b*) are front and side views, respectively, showing the external structure of an ink cartridge that is suitable for the structure shown in FIGS. 9 and 10.
Figure 12B:
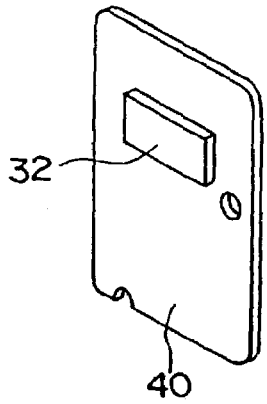

FIGS. 12(*a*) and 12(*b*) show the structure of the circuit board. The circuit board 40 has two stages of electrode terminal groups 33 arranged in the insertion direction of the cartridge as shown in FIG. 12(*a*). The IC memory 32 is mounted on the back of the circuit board as shown in FIG. 7(*b*). That is, the circuit board 40 shown in FIGS. 12(*a*) and 12(*b*) has one set of electrode terminals 33 as compared with the circuit board shown in FIGS. 7(*a*) and 7(*b*).

Figure 13A:
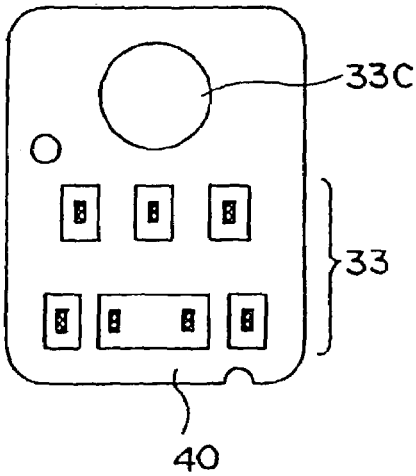
FIG. 13(*a*) and FIG. 13(*b*) are front and side views, showing a preferred example of a storage medium mounted on the ink cartridge shown in FIGS. 12(*a*) and 12(*b*).
Figure 13B:
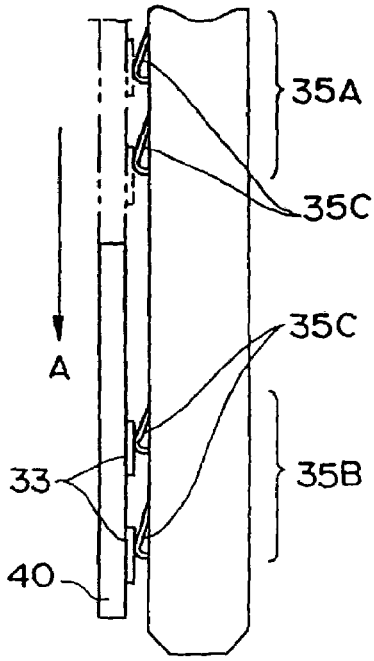

FIGS. 13(*a*) and 13(*b*) show a state in which the electrode terminal group 33 formed on the circuit board 40 contacts the first and second contact terminal groups 35A and 35B provided on the inner wall of the holder 31 at the above-mentioned first and second positions in the step of inserting the cartridge on the circuit board shown in FIGS. 12(*a*) and 12(*b*) in the holder.

When the cartridge is inserted in the holder and reaches the first position, the first contact terminal group 35A contacts the electrode terminal group 33 formed on the circuit board. This provides electric contact between the IC memory 32 and the read/write means 37 so that a read signal from the IC memory 32 is sent to the CPU 38 in the printing apparatus. At this time, as mentioned above, the CPU 38 in the printing apparatus reads the information held in the IC memory 32 via the read/write means 37 and checks if the inserted cartridge is an ink cartridge suitable for attachment.

When it is determined that the inserted cartridge is an ink cartridge suitable for attachment, the attachment of the cartridge is permitted as mentioned above. Accordingly, the cartridge is moved to the second position to be attached. At this time, the circuit board 40 attached to the cartridge relatively moves in the direction of an arrow A, causing the second contact terminal group 35B to contact the electrode terminal group 33 formed on the circuit board 40. The double hatched portions of the electrode terminal group 33 in FIG. 13(*a*) indicate where the second contact terminal group 35B is in contact.

Therefore, the IC memory 32 is in electric contact with the read/write means 37 and the CPU 38 in the printing apparatus can read the remaining amount of ink and suitable printing conditions retained in the IC memory 32 via the read/write means 37 and can prepare for execution of the printing process.

Figure 14:
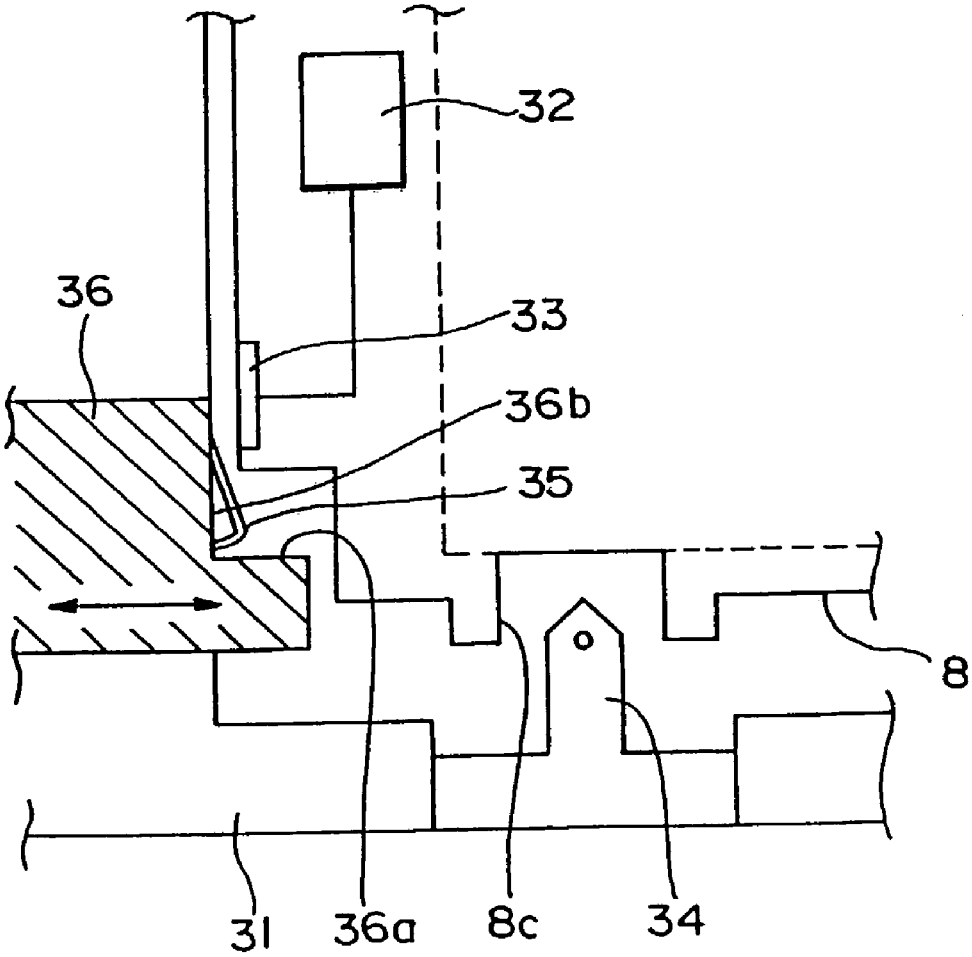
FIG. 14 provides a front view and a side view depicting the state of accessing cartridge information in the storage medium shown in FIGS. 13(*a*) and 13(*b*).

FIG. 14 shows an improved example of the embodiment shown in FIG. 9. In FIG. 14, same reference numerals are given to those portions that correspond to the portions of the structure shown in FIG. 9. In the structure shown in FIG. 14, the lock mechanism 36, which is movable and serves as an insertion inhibition means to temporarily inhibit the insertion of the cartridge to the first position, has a step 36*a*. The step 36*a* engages with the outer surface of the cartridge to lock the ink cartridge at the first position. The contact terminal 35, which can contact the electrode terminal 33 provided on the cartridge, is arranged on a vertical face 36*b* on which the step 36*a* of the lock mechanism 36 is formed.

This structure allows the cartridge to be positioned by the step 36*a* formed on the lock mechanism 36 when the ink cartridge is locked at the first position. Since the contact terminal 35 is located on the lock mechanism 36, the contact terminal 35 accurately contacts the electrode terminal 33 provided on the positioned cartridge.

Figure 15:
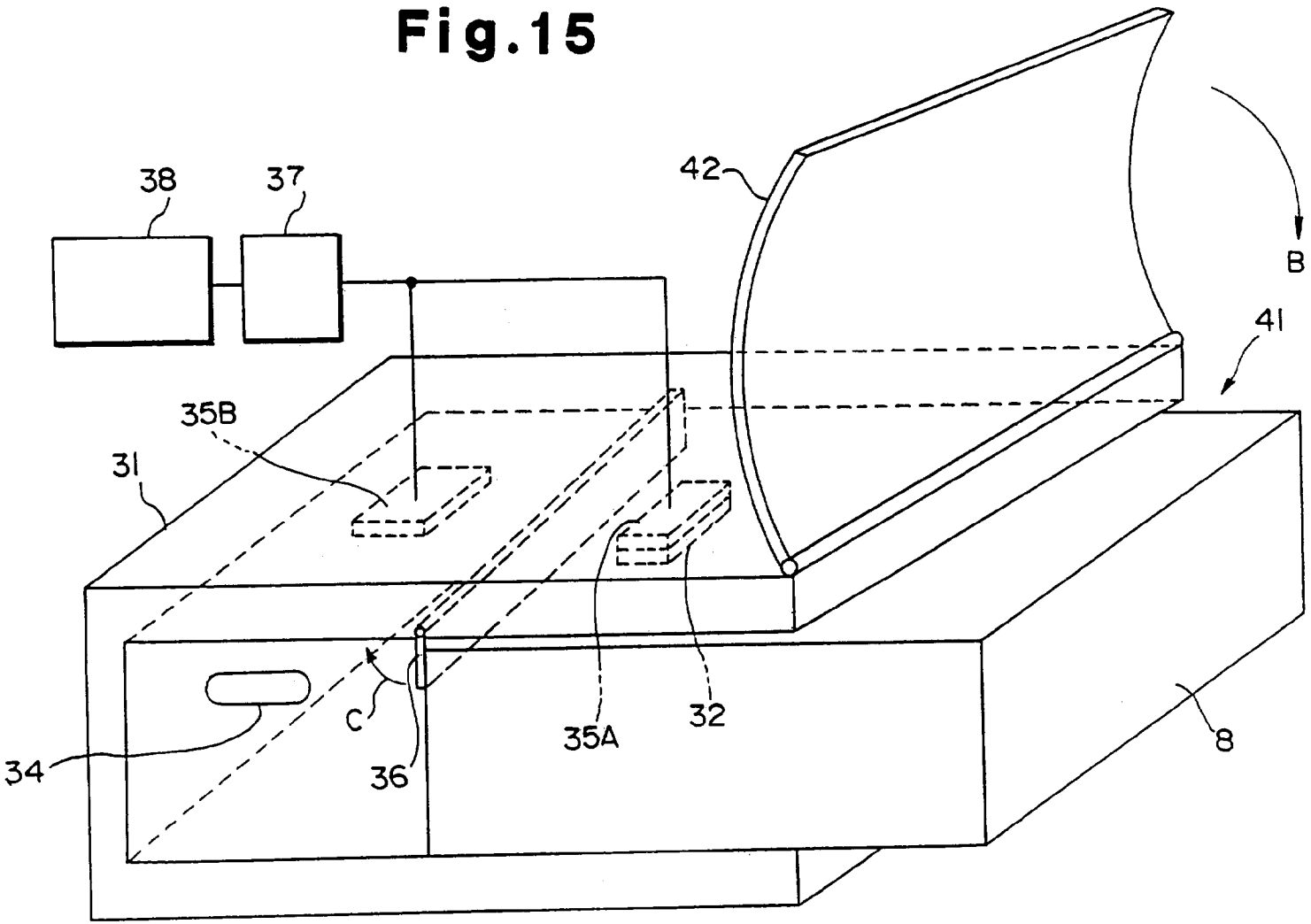
FIG. 15 is a diagrammatic perspective view according to a third embodiment illustrating a state immediately before an ink cartridge is attached to a cartridge holder.
Figure 16A:
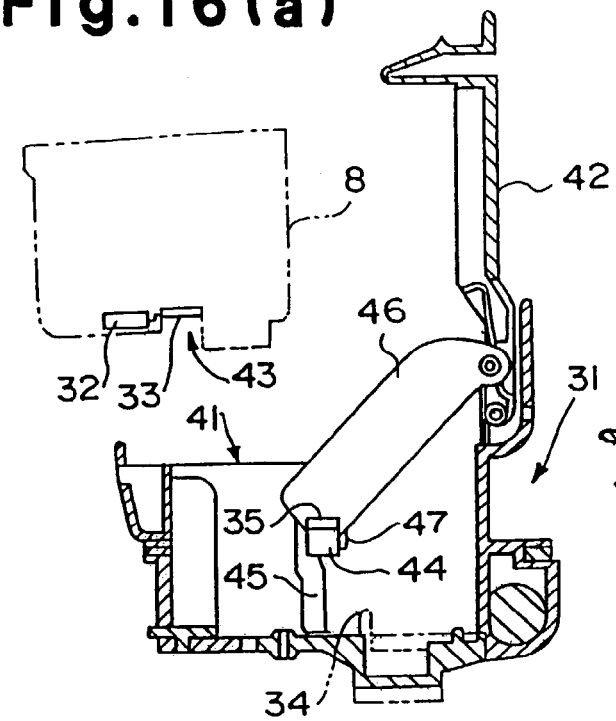
FIGS. 16(*a*), 16(*b*), 16(*c*), and 16(*d*) are partial cross-sectional views according to a fourth embodiment illustrating the attachment of an ink cartridge to a cartridge holder.
Figure 16C:
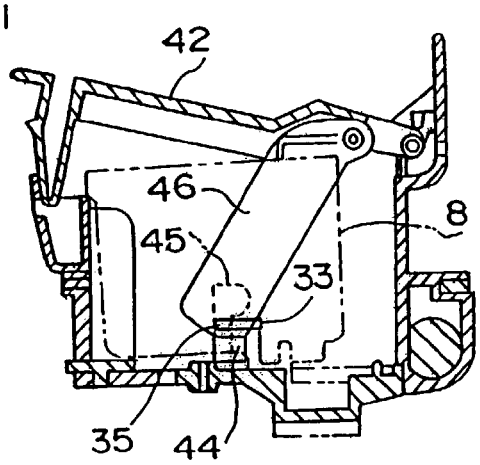
Figure 16B:
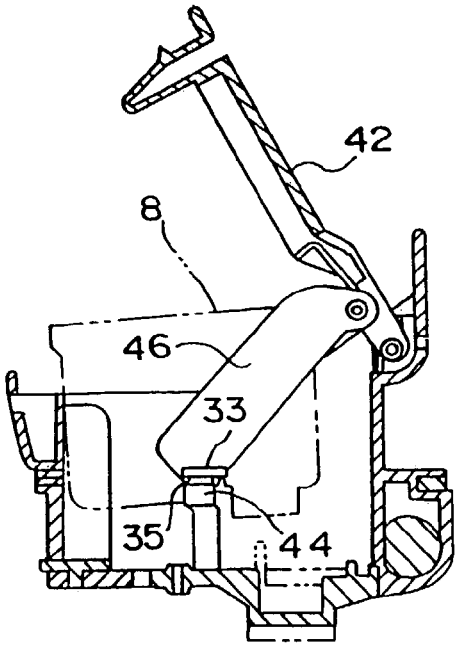
Figure 16D:
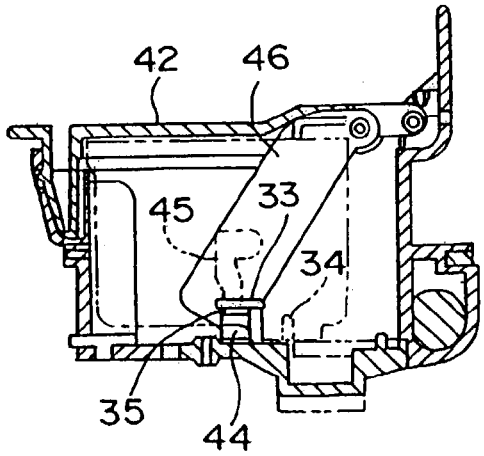

FIG. 15 shows a cartridge attachment mechanism according to the third embodiment in an exemplary diagram. In the embodiment shown in FIG. 15, the cartridge 8 is constructed to be attached horizontally to the cartridge holder 31. Therefore, the IC memory 32 that holds information for controlling the printing apparatus is provided on the top surface of the cartridge 8, which is approximately parallel to the insertion direction of the cartridge with respect to the cartridge holder 31. In this case, an access terminal to the IC memory 32 is formed on the top surface of the IC memory 32.

The holder 31 is constructed such that, as a lid 42 provided at an insertion hole 41 formed on the right-hand side in the diagram is closed in the direction of an arrow B, after the cartridge 8 is inserted halfway into the insertion hole 41, the lid 42 presses the cartridge 8 inwardly to the holder 31 to attach the cartridge 8. At this time, the ink feeding needle 34, which is provided at the deepest part of the holder 31, is inserted in the cartridge 8 and coupled thereto, so that ink can be led out of the cartridge 8.

The holder 31 is provided, at its top wall, with the lock mechanism 36 which locks the insertion of the cartridge to the first position, where the cartridge 8 is inserted halfway, or the position where the ink feeding needle 34 does not reach the ink protection film (not shown) provided on the cartridge 8. The lock mechanism 36 is constituted by a plate-like member having one end pivotally supported at the top wall of the holder 31. When it is determined that the inserted cartridge 8 is correct, the plate-like member constituting the lock mechanism 36 is sprung up toward the top wall of the holder 31 as indicated by an arrow C, thus permitting the attachment of the cartridge 8, as will be discussed later.

Two sets of contact terminals 35A and 35B for sending information from the IC memory 32 to the read/write means 37 are provided on the inner top wall of the holder 31 that faces the IC memory 32 provided on the cartridge 8. The first contact terminal 35A is located at a position where it can contact the access terminal formed on the top surface of the IC memory 32 when the cartridge 8 is inserted to the first position and locked by the lock mechanism 36, which is constituted by the plate-like member. The second contact terminal 35B is located at a position where it can contact the access terminal formed on the top surface of the IC memory 32 when the cartridge 8 is further inserted and reaches the second position.

In this embodiment, the CPU 38 determines the propriety of the installation of the cartridge 8 by accessing the IC memory 32 when the distal end of the cartridge 8 is inserted to the position of the lock mechanism 36 constituted by the plate-like member and informs the user of the result. When the result of the decision is that the cartridge 8 may be attached, the user can set the cartridge 8 inside the holder 31 by closing the lid 42.

When the cartridge 8 is set in the holder 31 and reaches the second position, signal exchange is performed with the access terminal formed on the top surface of the IC memory 32 via the second contact terminal 35B, and preparation for the printing process can be made as in the first and second embodiments.

FIGS. 16(*a*) to 16(*d*) show the structure of a cartridge according to the fourth embodiment and a holder therefor and shows an operation of attaching the cartridge to the holder. The ink cartridge 8 has a recess 43 formed at its bottom surface, extending in the lateral direction of the cartridge 8. The access terminal to the IC memory 32 or electrode terminal 33 is provided in this recess 43.

The cartridge holder 31 has a cartridge insertion hole 41; a lid 42; a support rod (extending parallel to the recess 43) 44, which enters the recess 43 of the cartridge 8 at the time the cartridge is inserted and supports the cartridge 8 from below; a guide groove 45, which is embedded in the inner wall of the holder, retains the end portion of the support rod 44 and guides the support rod 44 deep inside the holder 31; and a lifter 46, which guides the support rod 44 toward the guide groove 45 in response to the opening/closing of the lid 42. The ink feeding needle 34 is arranged on the inner bottom surface of the holder 31.

Arranged on the top surface of the support rod 44 is the contact terminal 35, which contacts the electrode terminal 33, which is the access terminal arranged in the recess 43, when the support rod 44 enters the recess 43 formed in the cartridge 8. The contact terminal 35 is connected to read/write means (not shown) which reads and writes information retained in the IC memory 32.

With this structure, when the ink cartridge 8 is to be attached, first, the lid 42 is opened fully as shown in FIG. 16(*a*). This causes the support rod 44 to enter and engage with a key-shaped portion 47 formed horizontally on the upper end of the guide groove 45.

Subsequently, as shown in FIG. 16(*b*), the cartridge 8 is inserted in the insertion hole 41 of the holder 31, and the recess 43 formed in the cartridge 8 is engaged with the support rod 44. As a result, the electrode terminal 33, which is located in the recess 43 of the cartridge, contacts the contact terminal 35 formed on the support rod 44, so that the CPU (not shown) of the printing apparatus is ready to access the IC memory 32 provided on the cartridge 8. That is, this state is equivalent to the first position before the attachment of the cartridge 8.

Then, the CPU of the printing apparatus reads information retained in the IC memory 32 and checks the propriety of the attachment of the cartridge 8. If the attachment is incorrect, the user is warned, and if the attachment is appropriate, the user is informed of such. Informed of the result of the determination on the propriety, the user performs an operation of closing the lid 42 as shown in FIG. 16(*c*).

In response to the closing operation of the lid 42, the support rod 44 moves downward along the guide groove 45 to guide the cartridge 8 deeper. Further, the operation of closing the lid 42 applies the pressing force of the lid 42 to the cartridge 8, causing the ink feeding needle 34 to enter the ink feeding port formed in the cartridge. Then, finally, as the lid 42 is closed completely, the attachment of the cartridge 8 is completed as shown in FIG. 16(*d*). That is, this state is equivalent to the second position when the cartridge is attached to the holder.

Even with the attachment of the cartridge completed, the contact terminal 35 provided on the support rod 44 is in contact with the electrode terminal 33 located on the cartridge 8. Therefore, the printing apparatus can read information from the IC memory 32 attached on the cartridge and execute suitable printing.

In the example shown in FIG. 16, the time of determining the propriety of the attachment of the cartridge 8 is not limited to that when the lid 42 is fully opened, but can be any time before the ink feeding port formed in the cartridge, preferably, before the ink protection film for sealing the ink feeding port is ruptured by the ink feeding needle 34.

Figure 17:
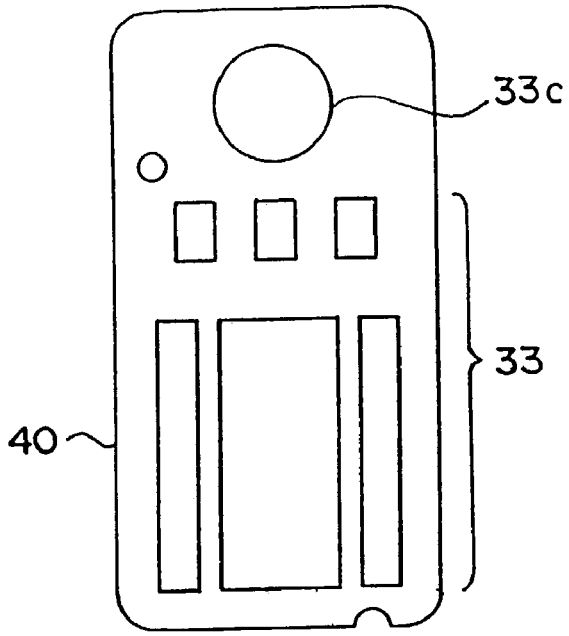
FIG. 17 is a front view depicting another preferred example of the storage medium mounted on the ink cartridge.

Next, FIG. 17 shows another example of the circuit board mounted on the ink cartridge on which the IC memory is attached. This circuit board 40 can be used for the ink cartridge shown in FIG. 6 and can be used in the embodiment illustrated in FIGS. 3 and 4. In the circuit board 40 shown in FIG. 17, the lower three electrode terminals of the two stages of electrode terminal groups 33 arranged in the insertion direction of the cartridge are long in the vertical direction.

With this structure, when the lower three electrode terminals, which are long in the vertical direction, are inserted to the first position, before the attachment of the cartridge, the lower end portions of the lower three electrode terminals can contact the first contact terminal 35A located on the holder side. At this time, information is read out from the IC memory using the three electrode terminals to determine the propriety of the attachment of the cartridge.

In the state where the cartridge is attached to the holder in the second position, the upper three electrode terminals and the upper end portions of the lower three electrode terminals of the two groups can contact the second contact terminal 33B located on the holder side at the upper end portion of the lower three electrode terminals.

Figure 18:
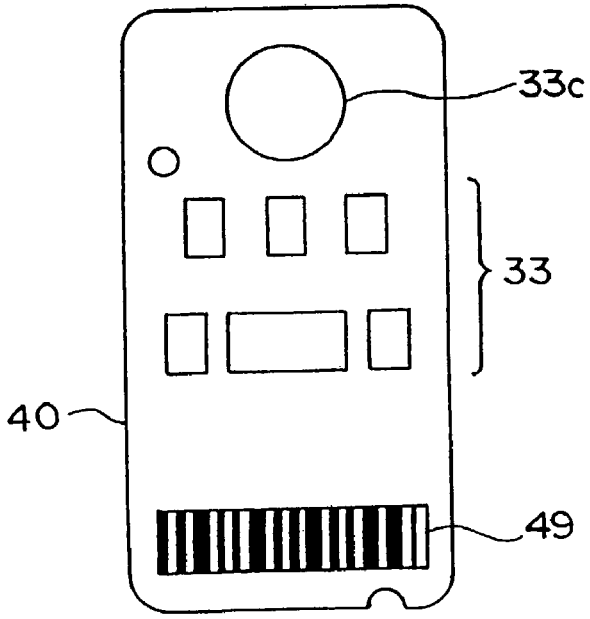
FIG. 18 is a front view depicting a further preferred example of the storage medium mounted on the ink cartridge.

FIG. 18 depicts a further example of the circuit board provided on the ink cartridge on which the IC memory is attached. The circuit board 40 has an array of optically readable patterns or a bar code 49 formed at its lower end. With the cartridge is inserted to the first position before attachment, the bar code 49 is read by a bar code reader located on the holder side. Based on information of the bar-code pattern array, the propriety of the attachment of the ink cartridge can be determined.

Figure 19:
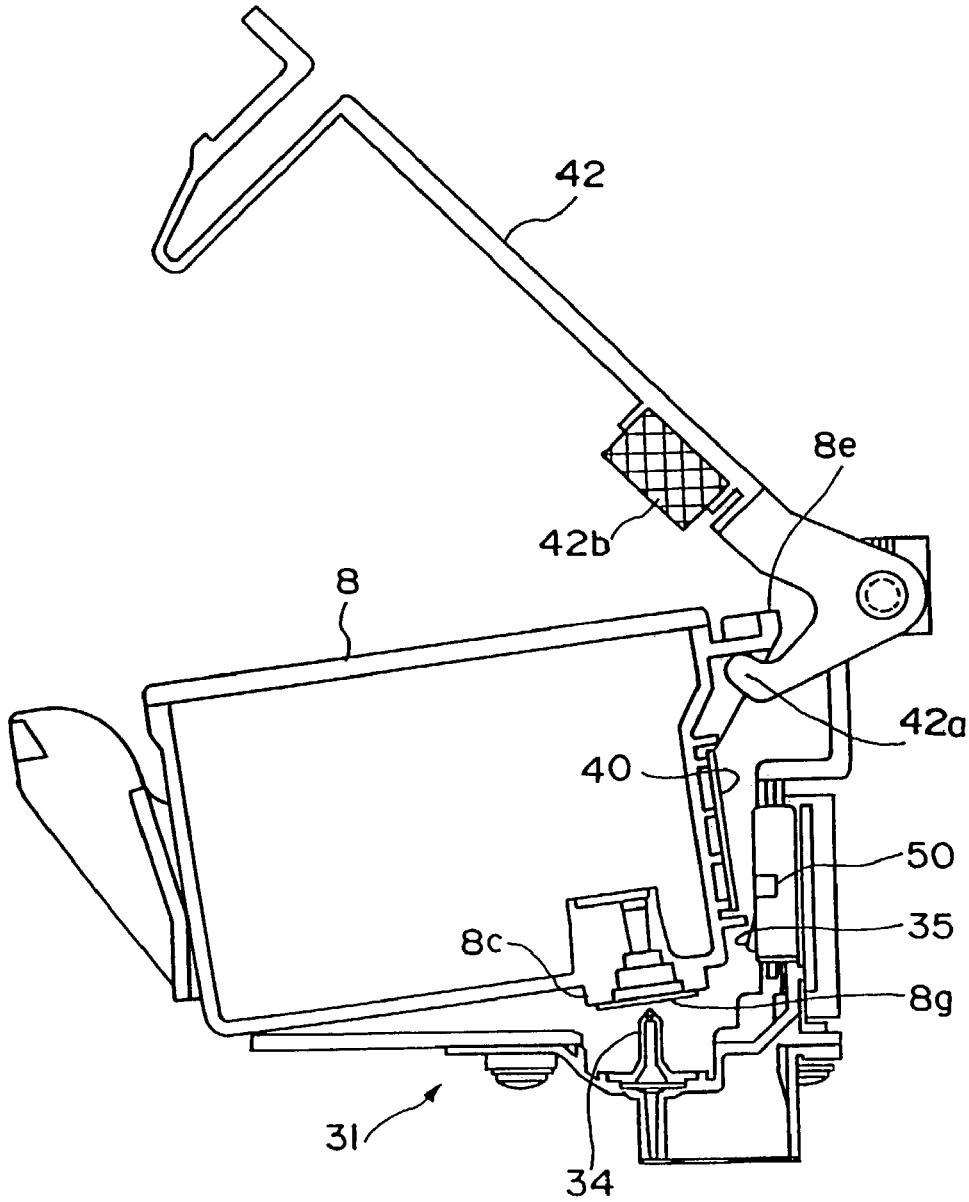
FIG. 19 is a cross-sectional view illustrating a state immediately before an ink cartridge is attached to a cartridge holder formed on a carriage when the storage medium with the structure shown in FIG. 18 is used.

FIG. 19 illustrates the structure of the cartridge 8 on which the circuit board shown in FIG. 18 is attached and the structure of the holder 31 in which the cartridge is attached, in a cross-sectional view. In FIG. 19, same symbols are given to those portions that correspond to the portions that have already been discussed. In the example shown in FIG. 19, a hook-shaped projection 42*a* is formed at the proximal end portion of the lid 42 and, as the cartridge is inserted as illustrated, the overhang portion 8*e* formed on the corresponding side of the ink feeding port 8*c* of the cartridge receives the hook-shaped projection 42*a*. That is, the cartridge 8 is set at the first position before attachment in the holder 31.

A bar-code reader 50 is provided on the inner wall of the holder and can read the bar code 49 on the circuit board 40 of the cartridge 8 at the first position. By analyzing the bar code, the propriety of the attachment of the cartridge 8 inserted to the first position can be determined.

When it is determined that the inserted cartridge is correct and a message or the like to that effect is obtained, closing the lid 42 causes the hook-shaped projection 42*a* formed at the proximal end of the lid 42 to retract downward so that the cartridge 8 is pressed into the holder 31 via an elastic member 42*b* provided at the back of the lid 42. As a result, the protection film 8*g* for sealing the ink feeding port 8*c* is ruptured by the ink feeding needle 34 and the ink feeding port 8*c* is connected to the ink feeding needle 34.

In this state (the second position), the electrode terminal 33 of the circuit board 40 attached on the cartridge contacts the contact terminal 35 located to the holder so that the printing apparatus can read information in the IC memory 32 attached on the cartridge and execute suitable printing.

Although information for determining the propriety of the attachment of the cartridge is acquired in a non-contact mode in the above-described example, it is possible to employ a scheme of transmitting information in the IC memory 32 attached to the cartridge to the holder by a radio transmission device. The radio transmission device must have a structure to permit the exchange of signals across a distance of several millimeters using very weak radio waves.

Figure 20:
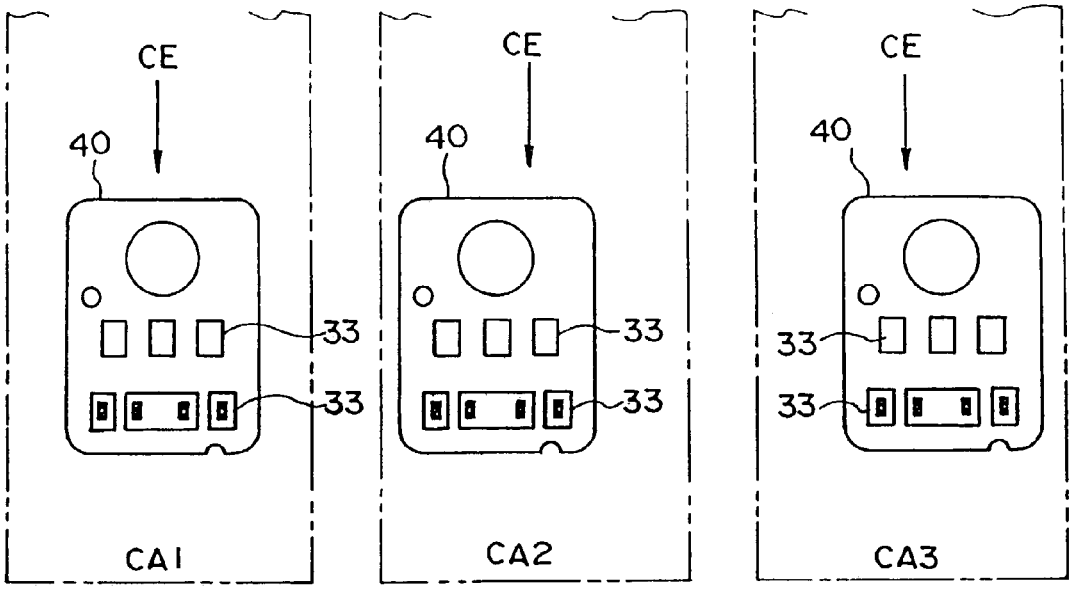
FIG. 20 is a front view of the storage medium for illustrating the location of the storage medium with respect to the ink cartridge and an access situation.

FIG. 20 shows a further example of the circuit board that has the IC memory attached thereto and is provided on an ink cartridge. The example shown in FIG. 20 is designed such that, with the ink cartridge inserted to the first position, the propriety of the attachment of the ink cartridge can be determined in accordance with the conductive states of the contact terminals arranged on the printing apparatus, which contact the electrode terminals on the cartridge.

That is, the structure shown in FIG. 20 shows a structure where the circuit board 40 is arranged with respect to each of different three cartridges CA1, CA2 and CA3. Those circuit boards have the same structures as the structure of the circuit board shown in FIGS. 12(*a*) and 12(*b*) that has already been described. The circuit boards 40 are designed to have different positions of attachment to the respective cartridges. The circuit board 40 is attached to nearly the center of the first cartridge CA1 as indicated by an arrow CE, is attached to the second cartridge CA2 on the left side of the arrow CE indicating the center, and is attached to the third cartridge CA3 on the right side of the arrow CE indicating the center.

The contact terminals that contact the lower electrode terminal of the circuit board 40 when the cartridge is inserted in the holder and is in the first position are provided on the holder side. The contact terminals provided on the holder side are arranged with slight deviations in the right and left direction with reference to the center portion where each cartridge is inserted.

In the example shown in FIG. 20, a pair of contact terminals contact the lower electrode terminal on the circuit board 40, particularly, the center, wide electrode terminal, as indicated by double hatching, thereby making a conductive state. In the example shown in FIG. 20, therefore, it is shown that each of the three cartridges CA1, CA2, CA3 can be attached correctly.

If the first cartridge CA1 is inserted in the holder in which the second cartridge CA2 belongs, the contact terminals arranged on the holder side cannot acquire the aforementioned conductive state. In this case, therefore, incorrect insertion of the cartridge can be detected.

Figure 21:
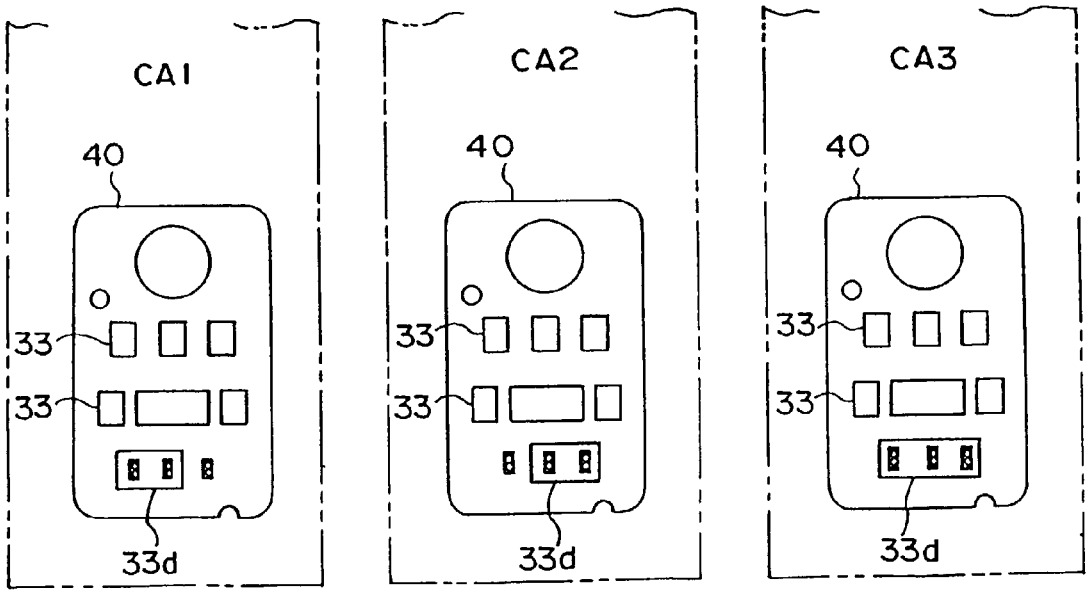
FIG. 21 is a front view of the storage medium for illustrating another situation of access to the storage medium located on the ink cartridge.

FIG. 21 shows a still further example of the circuit board that has the IC memory mounted thereon and is provided on an ink cartridge. The example shown in FIG. 21 shows an example in which, with the ink cartridge inserted to the first position, an exclusive electrode terminal 33*d*, which contacts the contact terminals arranged on the printing apparatus, is formed on the circuit board 40.

In the example shown in FIG. 21, the exclusive electrode terminal 33*d* is provided slightly to the left on the circuit board 40 on the first cartridge CA1. On the second cartridge CA2, the exclusive electrode terminal 33*d* is provided slightly to the right side on the circuit board 40. On the third cartridge CA3, the exclusive electrode terminal 33*d* is formed widely on the circuit board 40.

As indicated by double hatching, three contact terminals are arranged on the holder. In accordance with the pattern of the exclusive electrode terminal 33*d* described above, therefore, the state of connection of the electrode terminal 33*d* changes. By detecting this state, it is possible to determine the propriety of the attachment of the ink cartridge.

Although the above has described several preferable modes of the first aspect of the invention, those are merely illustrative for explaining the invention, and the scope of the invention is not to be limited to those modes. The invention may be embodied in various other modes. For example, the IC memory may be replaced with an optical storage medium. In the case of using a storage medium, such an optical storage medium, the data of which is directly read or written by read and write heads, the storage medium is provided at the position of the circuit board 40 in the above-described modes, and read and write heads are provided in place of the contact terminals 35.

A printing apparatus according to the second aspect of the invention and an ink cartridge change control method for the apparatus will now be discussed with reference to FIGS. 22 to 29. The feature of the printing apparatus according to the second aspect lies in that the apparatus is constructed such that when information is read out from the storage medium and it is determined that the inserted cartridge is proper, as mentioned earlier, the ink intake means for letting the ink out is driven to be connected to the ink feeding port of the cartridge.

The printing apparatus according to the second aspect of the invention also employs the above-described structure shown in FIGS. 1 and 2. A user can pull the cartridge from the carriage by lifting up a cartridge fixing lever 51, to be discussed later, which is located on the carriage and is moved to the ink cartridge change window 21, as shown in FIG. 2. After a new cartridge is attached, as the cartridge fixing lever 51 is pulled down to fix it, information about the cartridge is read out from the storage medium mounted on the newly attached cartridge to determine whether or not this cartridge can be used, as will be discussed later.

When it is determined that the cartridge is usable, the carriage is moved from the ink cartridge change window 21 to the home position, where the capping device 9 is located, and the hollow ink feeding needle is connected to the attached cartridge.

Figure 22:
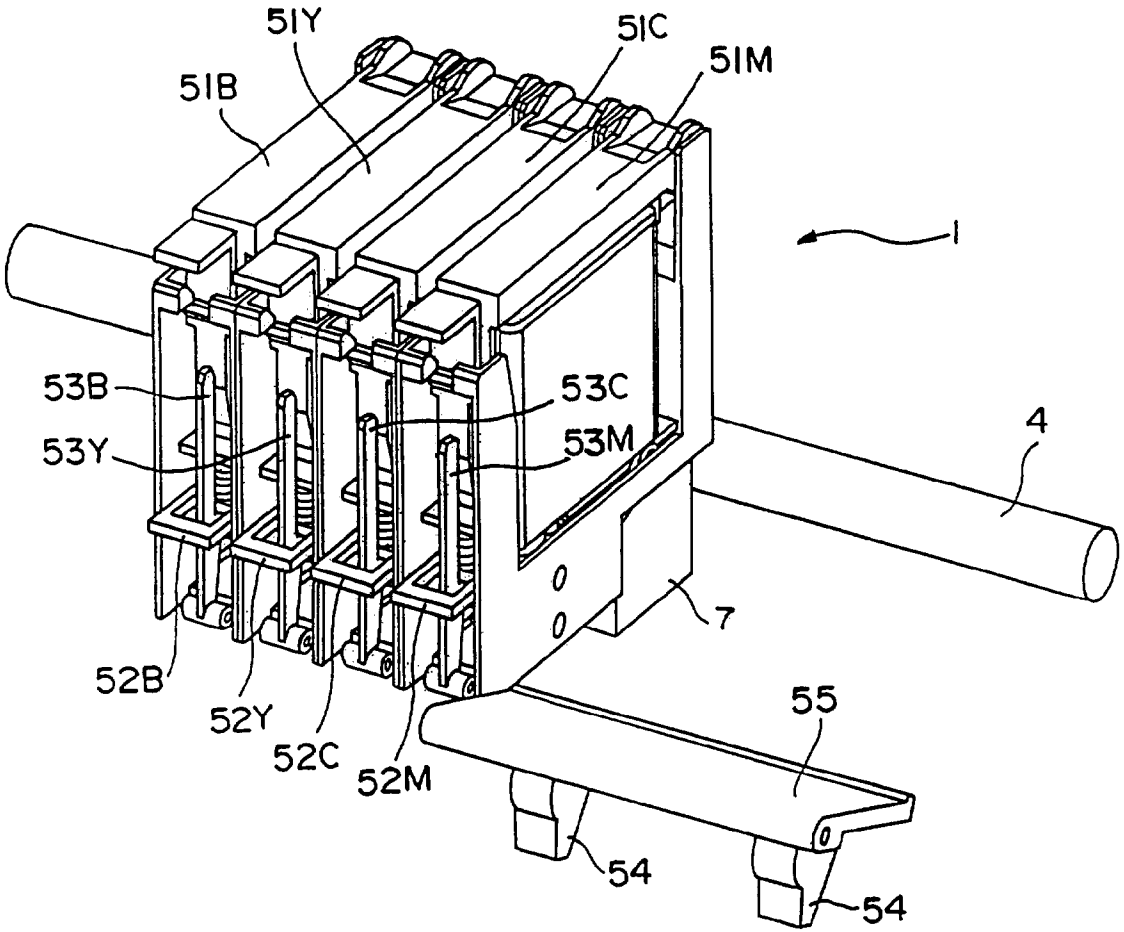
FIG. 22 is a perspective view showing the overall structure of cartridge holders mounted on a carriage in a printing apparatus according to the second aspect of the invention.
Figure 23:
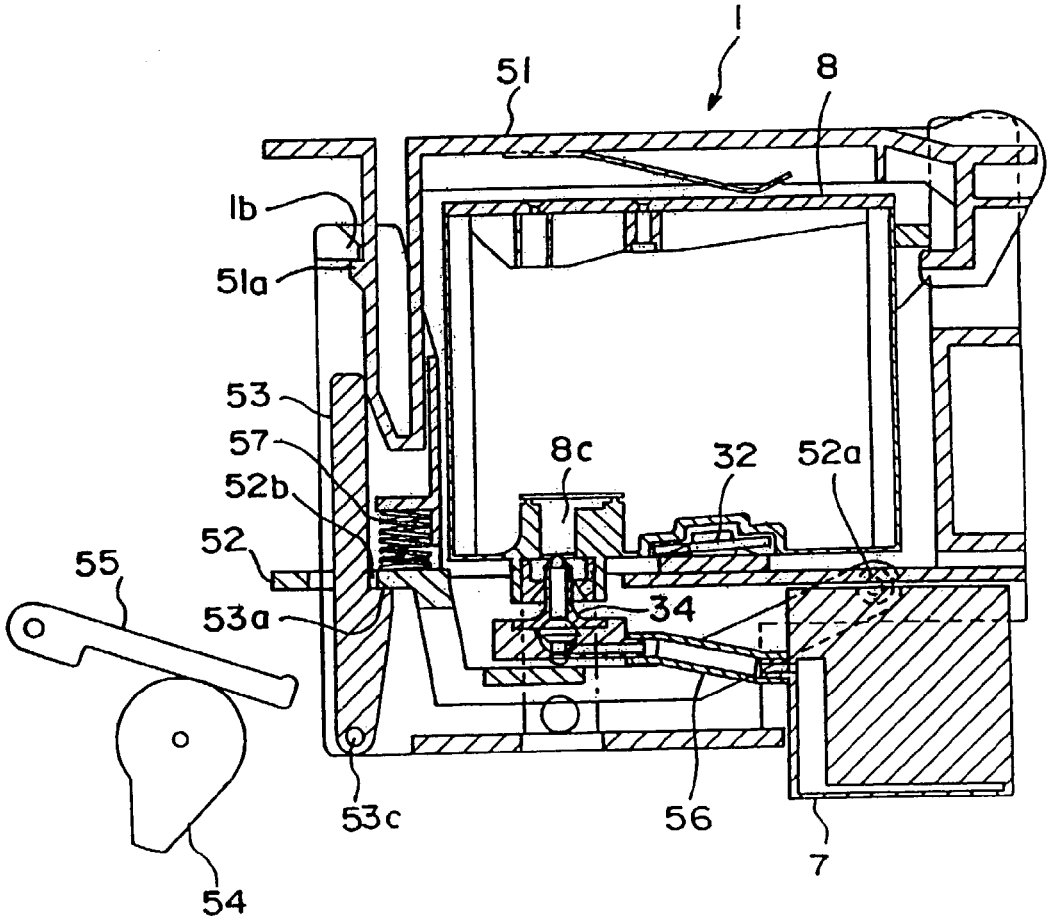
FIG. 23 is a cross-sectional view showing the state where an ink cartridge is attached to one of the cartridge holders shown in FIG. 22.
Figure 24:
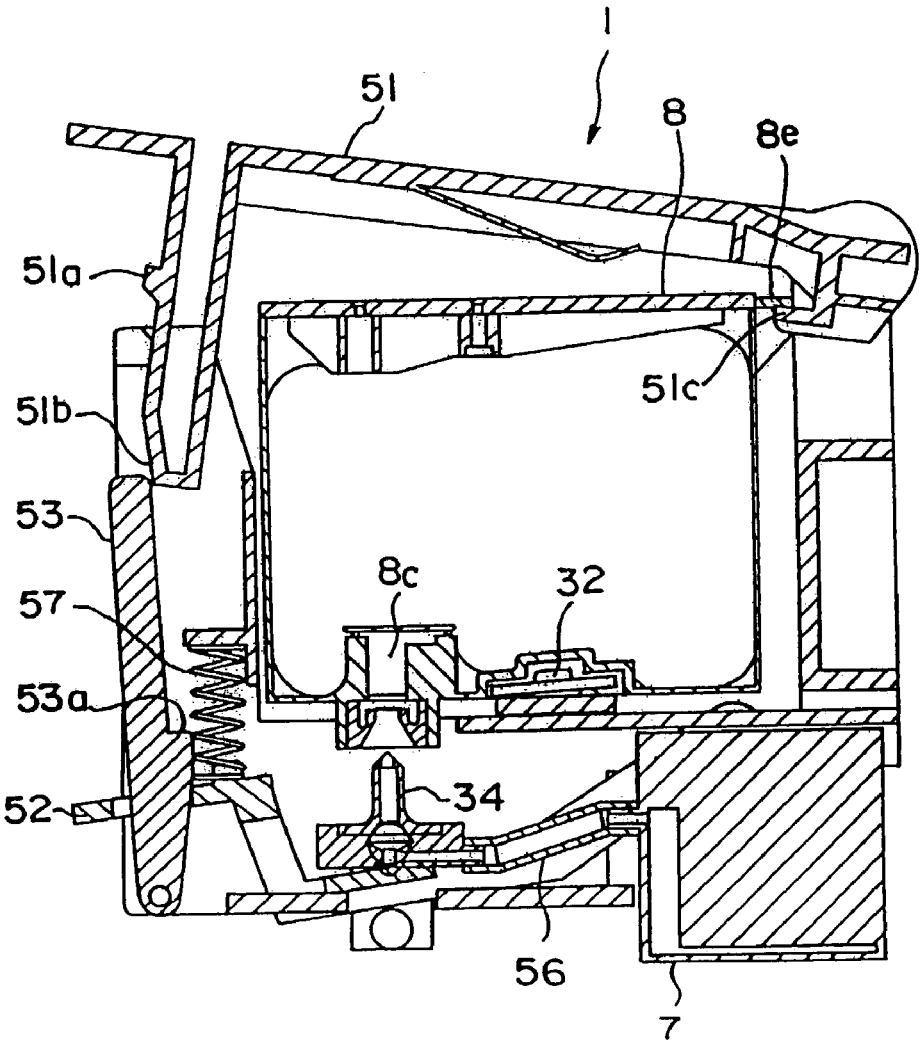
FIG. 24 is a cross-sectional view like FIG. 23 showing a cartridge change lever slightly lifted up.
Figure 25:
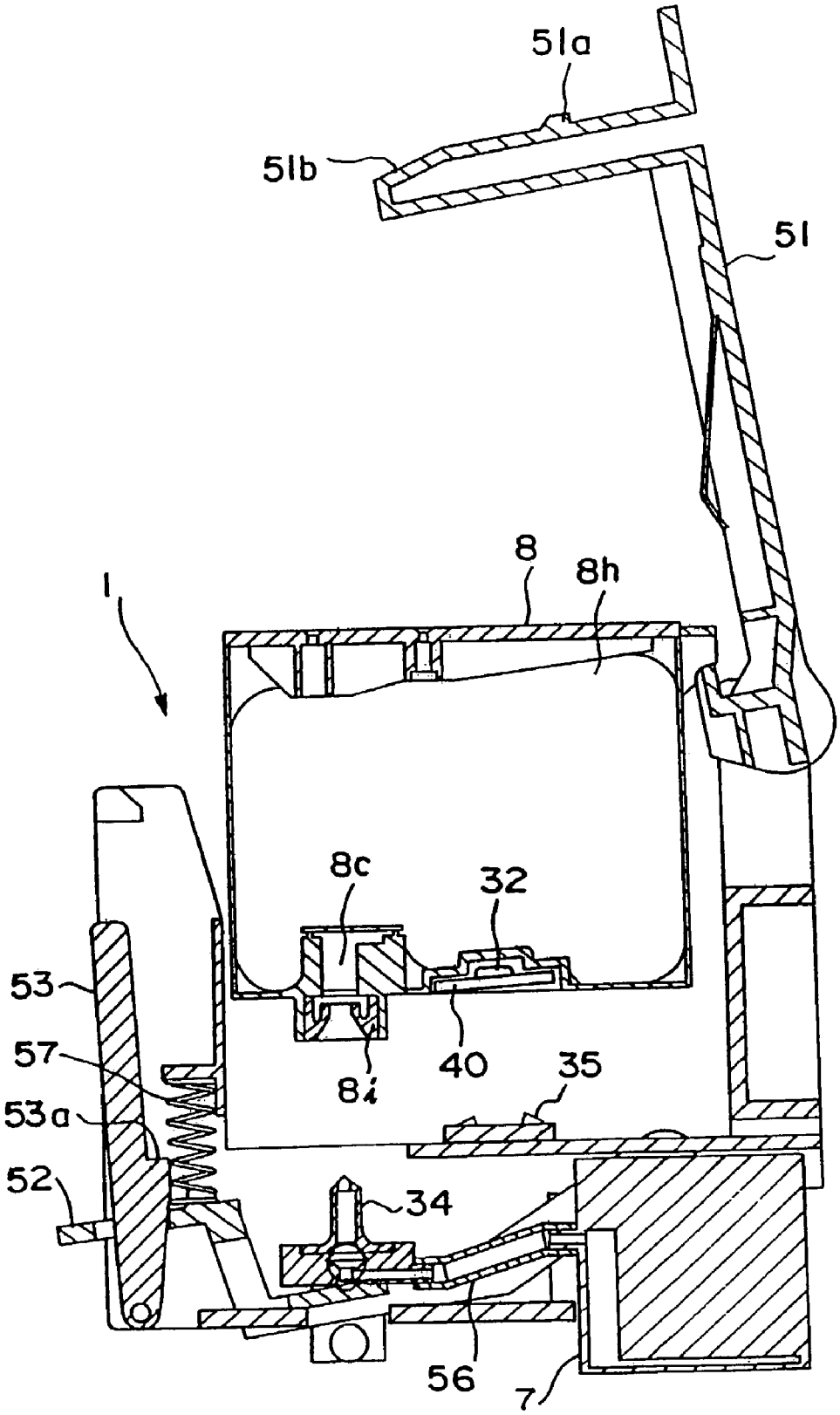
FIG. 25 is a cross-sectional view like FIG. 24 showing the state where a cartridge is prepared for replacement by further lifting the cartridge change lever upward.
Figure 26:
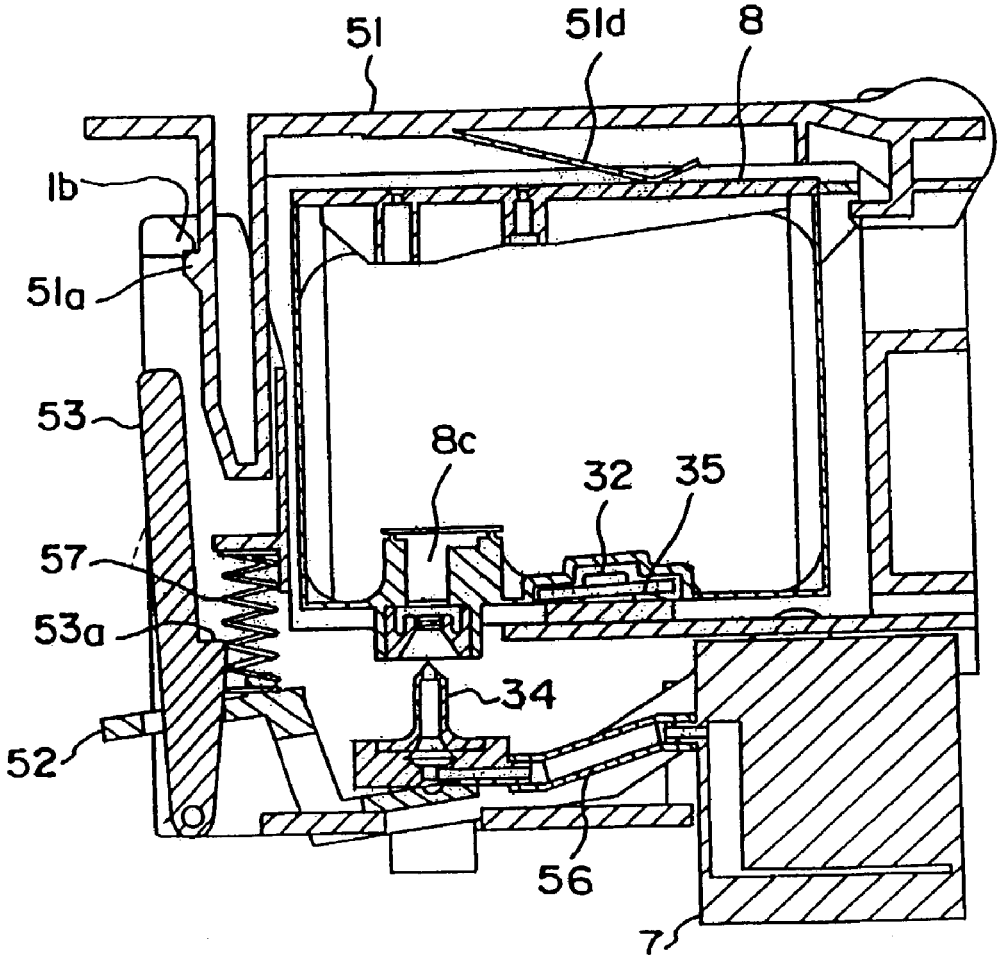
FIG. 26 is a cross-sectional view like FIG. 25 showing the cartridge change lever moved downward after a new ink cartridge has been attached.
Figure 27:
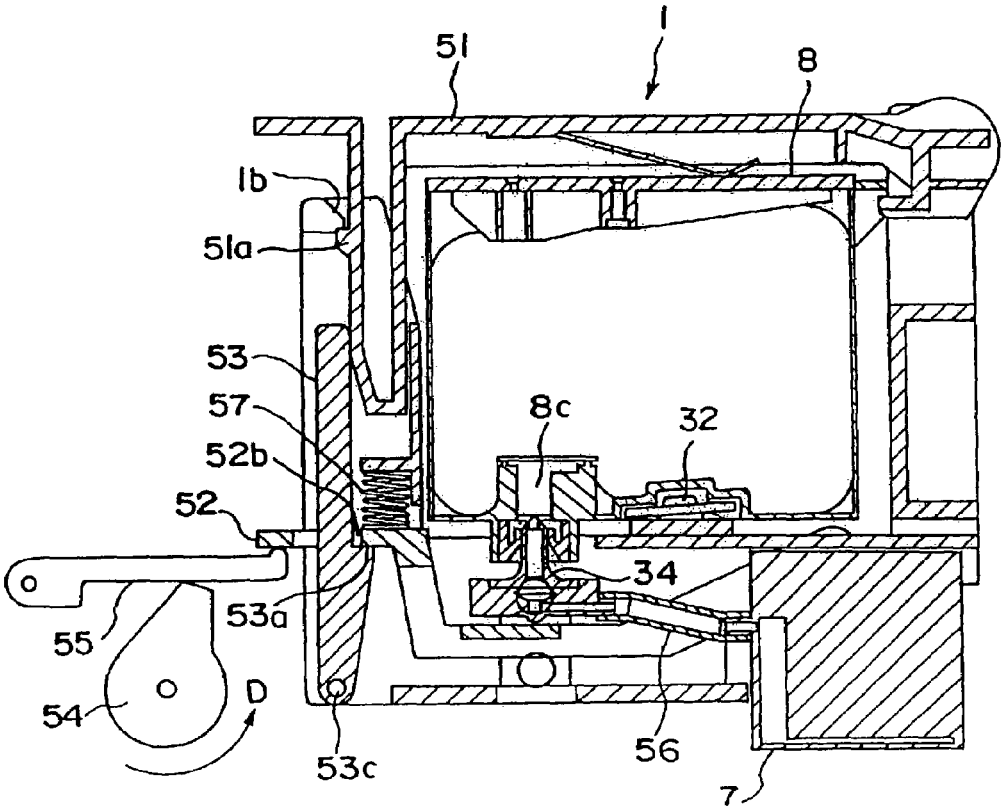
FIG. 27 is a cross-sectional view like FIG. 26 showing ink feeding needles connected to the attached cartridge.

FIG. 22 shows the overall structure of cartridge holders mounted on the carriage 1 in a perspective view. This mode is designed such that ink cartridges retaining black, yellow, cyan and magenta inks are attached, as has been explained with reference to FIG. 1. FIGS. 23 through 27 show a sequence of operations that are executed when one of the ink cartridges is to be changed. FIG. 23 shows a printable state, FIG. 24 shows a cartridge change lever slightly lifted up, FIG. 25 shows the cartridge change lever lifted up further so that the cartridge can be changed, FIG. 26 shows the cartridge change lever lifted down after a new ink cartridge is attached, and FIG. 27 shows the ink feeding needle connected to the attached ink cartridge so that the ink is led out, all in cross-sectional views.

First, as shown in FIG. 22, the carriage 1 is designed such that it is guided by the guide rod 4 and is movable horizontally. Cartridge fixing levers 51B, 51Y, 51C and 51M are arranged on the top surface of the carriage 1 in association with the respective ink cartridges. Attached to the bottom surface of the carriage 1 is a printing head 7 which receives ink from the attached cartridges.

Parts of feed-needle drive levers 52B, 52Y, 52C and 52M, which are described in detail later, appear at the front of the carriage 1. The feed-needle drive levers 52B, 52Y, 52C and 52M are constructed to be engaged and disengaged by stopper levers 53B, 53Y, 53C and 53M, respectively.

Symbol "54" in FIG. 22 indicates a cam member located at the home position, and a set lever 55, which is pushed up by the rotation of the cam member 54, is provided. When the carriage 1 is moved to the home position, the end portions of the feed-needle drive levers 52B, 52Y, 52C and 52M are lifted up by the set lever 55 and are engaged with the stopper levers 53B, 53Y, 53C and 53M, as will be discussed later.

An operation of changing an ink cartridge will now be discussed with reference to FIGS. 23–27. Because FIGS. 23–27 sequentially illustrate the operation of changing a single ink cartridge, as mentioned above, same symbols without B, Y, C and M, which indicates the types of inks shown in FIG. 22, are shown.

The ink cartridge 8, which is used in this printing apparatus and the characteristic of which are shown in, for example, FIG. 25, retains a porous member 8*h* and is held in the state where the porous member 8*h* is impregnated with ink. An ink feeding port 8*c* is formed in the front portion of its bottom, and a ring-like packing member 8*i* is attached inside the hole. An ink protection film is attached to the lower end portion of the ink feeding port 8*c*, though not illustrated, so that vaporization of the ink solvent during keeping is prevented.

The IC memory 32, which is a readable and writable storage medium, is attached to the rear portion of the bottom of the ink cartridge 8 in the state where it is mounted on a board 40. As mentioned above, information, such as the type of the ink in the cartridge or the production date (or the usable period), is written in the IC memory 32.

The contact terminals 35 that contact the board 40, when the cartridge is attached, are arranged on the carriage, and information indicating whether or not the cartridge has been attached to the carriage and the information stored in the IC memory 32 can be read out via the contact terminals 35.

The feed-needle drive lever 52 is designed such that its free end is rotatable vertically through a spindle 52*a* as shown in FIG. 23. Linked with the rotation of the feed-needle drive lever 52, the hollow ink feeding needle 34 that constitutes the ink intake means can move up and down while remaining perpendicular to the axis.

With this structure, the state where the ink feeding needle 34 is inserted in and connected to the ink feeding port 8*c* of the attached ink cartridge as shown in, for example, FIG. 23 or the state where the ink feeding needle 34 is moved downward and are removed from the ink feeding port 8*c* of the ink cartridge as shown in, for example, FIG. 24 is selected. A flexible ink feeding tube 56 from the ink feeding needle 34 is connected to the printing head 7, so that the ink led out of the cartridge by the ink feeding needle 34 is supplied to the printing head 7 via the ink feeding tube 56.

FIG. 23 shows the printable state where the ink feeding needle 34 is inserted in and connected to the ink feeding port 8*c* of the attached ink cartridge. In this state, an engagement portion 53*a* formed on the stopper lever 53 is engaged with the edge of an engagement hole 52*b* formed in the feed-needle drive lever 52 so that the free end of the feed-needle drive lever 52 is held in its upward position. The stopper lever 53 is pivotally supported by a spindle 53*c*. The stopper lever 53 is designed such that its free end is urged rightward in the diagram (clockwise) by an unillustrated spring member.

When changing the ink cartridge, the carriage 1 is moved from the home position to the ink cartridge change window 21, as shown in FIG. 2, by manipulating a cartridge change switch 73, which is discussed later. Lifting the front end of the cartridge fixing lever 51, shown in FIG. 23, disengages an engagement projection 51*a* formed on the cartridge fixing lever 51 from an engagement portion 1*b* formed on the body of the carriage 1.

As the cartridge fixing lever 51 is further pulled up, a bent portion 51*b* formed on the cartridge fixing lever 51 abuts against the stopper lever 53 and pushes the free end of the stopper lever 53 frontward (leftward in FIG. 24).

Accordingly, the engagement portion 53*a* formed on the stopper lever is disengaged from the edge of the engagement hole 52*b*, which is formed in the feed-needle drive lever 52, and the feed-needle drive lever 52 is affected by the force of a spring member 57 provided between the drive lever 52 and the body of the carriage, so that the free end of the feed-needle drive lever 52 moves downward. As a result, the ink feeding needle 34 is moved downward and is removed from the ink feeding port 8*c* of the ink cartridge as shown in FIG. 24.

At this time, a claw 51*c* formed at the proximal end portion of the cartridge fixing lever 51 engages the overhang portion 8*e* formed on the ink cartridge 8 and pushes the ink cartridge 8 upward. In the state shown in FIG. 25, where the front end portion of the cartridge fixing lever 51 is further lifted, the ink cartridge 8 can be separated from the carriage.

In the state shown in FIG. 25, as a new ink cartridge 8 is attached again and the cartridge fixing lever 51 is pulled down, the engagement projection 51*a* formed on the cartridge fixing lever 51 is engaged with the engagement portion 1*b* as shown in FIG. 26. At this time, a leaf spring 51*d* located at the underside of the fixing lever 51 abuts against the top surface of the cartridge 8 and presses the cartridge 8 downward. Therefore, the IC memory 32 attached to the cartridge 8 is connected to the printing apparatus via the contact terminals 35. This makes it possible to read cartridge information written in the IC memory 32.

As will be discussed later, the printing apparatus reads and analyzes the cartridge information written in the IC memory 32. When it is determined that the cartridge is usable, an operation of moving the carriage 1 to the home position is executed. When the carriage 1 is moved to the home position, the cam member 54, which is located at the home position, is rotated once in the direction indicated by an arrow D, as shown in FIG. 27.

The rotation of the cam member 54 lifts the set lever 55 so that the distal end of the set lever 55 abuts against and lifts the feed-needle drive lever 52. Therefore, the engagement portion 53*a* formed on the stopper lever 53 engage the edge of the engagement hole 52*b* formed in the feed-needle drive lever 52, and the feed-needle drive lever 52 is locked with its free end in the upward position. At this time, the ink feeding needle 34 moves upward to connect to the ink feeding port 8*c* of the attached ink cartridge, so that the ink is fed to the printing head 7 from the cartridge as mentioned above.

Figure 28:
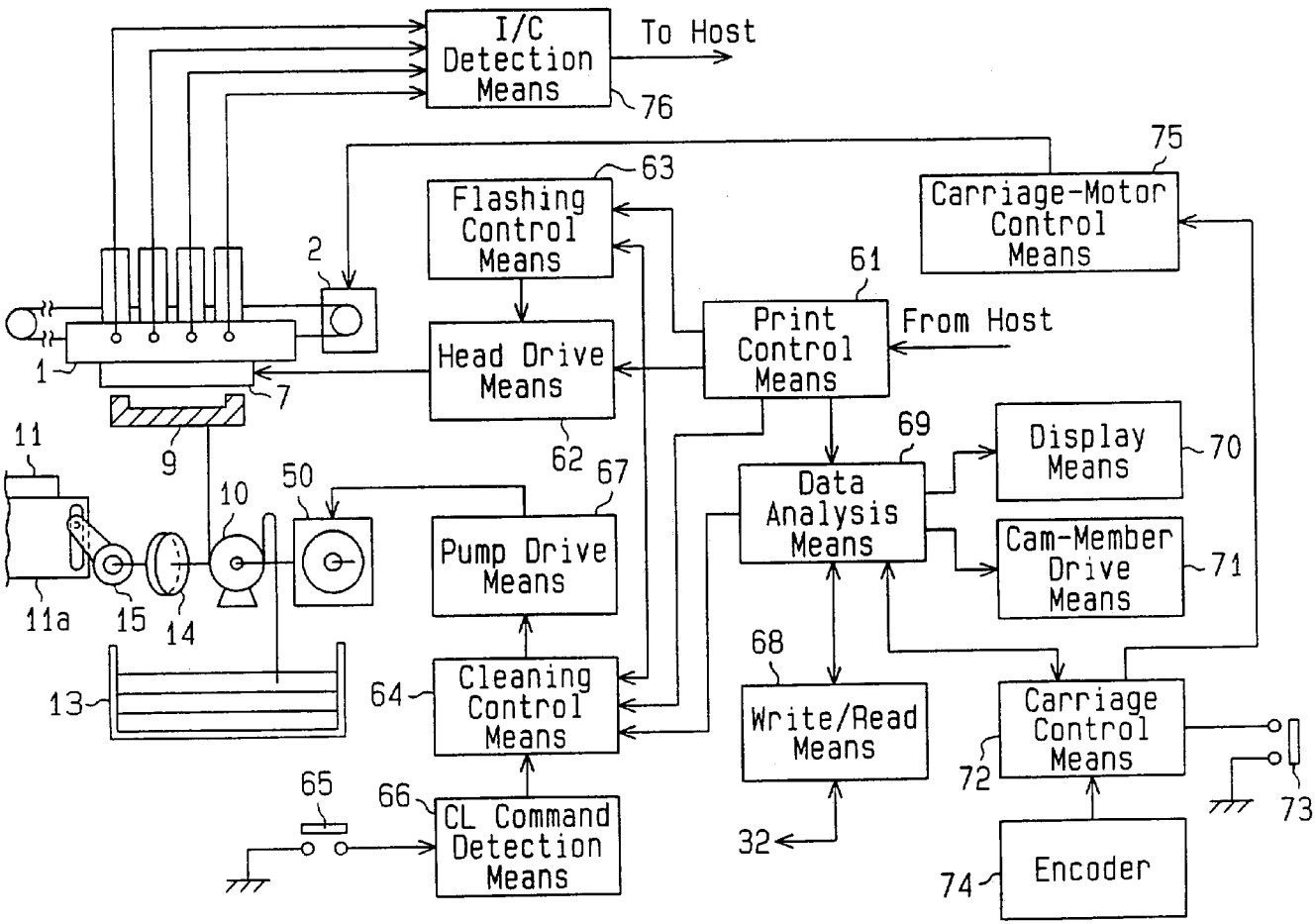
FIG. 28 is a block diagram depicting the structure of a control circuit provided in the printing apparatus according to the second aspect of the present invention.

FIG. 28 depicts an example of a control circuit that is provided in the printing apparatus with the above-described structure and accomplishes the ink cartridge change control method according to the invention. In FIG. 28, same symbols are given to those portions that correspond to the portions that have already been explained, and their description will be omitted. As shown in FIG. 28, the aforementioned suction pump 10 is connected to the capping device 9 and the discharge side of the suction pump 10 is connected to a waste liquid tank 13.

This embodiment is designed such that the drive force of a motor 60, which drives the suction pump 10, turns a lever 15 in either direction via a friction clutch 14. The rotation of the lever 15 causes a hold member 11*a* for holding the wiping member 11 to slide horizontally, thus ensuring a wiping operation in which the wiping member 11 enters the moving track of the printing head 7 to wipe the nozzle of the printing head 7 clean.

Symbol "61" shown in FIG. 28 refers to print control means, which has a capability of generating bit map data based on print data from a host computer and causing head drive means 62 to generate a drive signal based on this data to discharge ink droplets from the printing head 7 mounted on the carriage 1. This head drive means 62 is designed to also send a drive signal for a flashing operation to the printing head 7 upon reception of a flashing command signal from flashing control means 63, in addition to the print-data originated drive signal.

Symbol "64" refers to cleaning control means, which has a executes a cleaning operation in response to a command signal from cleaning command detection means 66 in response to the ON action of a cleaning command switch 65 located on the operational panel 18. The cleaning control means 64 has likewise can execute the cleaning operation even when receiving a cleaning command from the host computer via the print control means 61.

The cleaning control means 64 can control the pump drive means 67 to drive the motor 60, thereby driving the suction pump 10 or the like, when receiving the cleaning command. The driving of the suction pump 10 applies negative pressure to the inner space of the capping device 9 to draw the ink out of the nozzle opening of the printing head 7. As the suction pump 10 is driven again while the seal by the capping device 9 released, the waste ink discharged into the internal space of the capping device 9 can be disposed into the waste liquid tank 13.

Symbol "68" denotes read/write means, which acts to read cartridge information stored in the IC memory 32 attached to each ink cartridge mounted on the carriage. The information about the cartridge that has been read by the write/read means 68 is sent to data analysis means 69, which is constructed to analyze the information.

Display means 70 and cam-member drive means 71 are connected to data analysis means 69. Further connected to the data analysis means 69 is carriage control means 72 so that control signals are exchanged with the carriage control means 72. The carriage control means 72 can drive and control the carriage motor 2 by sending a command signal to carriage-motor control means 75. A signal from an encoder 74 is supplied to the carriage control means 72.

The encoder 74 is capable of, for example, optically detecting the moving position of the carriage and is constructed to control the movement of the carriage 1 from the home position to the ink cartridge change window 21 as the cartridge change switch 73 connected to the carriage control means 72 is manipulated.

Ink-cartridge detection means 76, which detects the state of the attachment of the ink cartridge to the carriage 1, is provided, and information detected by the ink-cartridge detection means 76 can be sent to the host computer. As shown in FIG. 25, the ink-cartridge detection means 76 is constructed to electrically determine whether the IC memory 32 mounted on the cartridge has been connected to the contact terminals 35 when the cartridge is mounted on the carriage.

A description will now be given of the ink cartridge change control procedure that is executed by the control circuit shown in FIG. 28 with reference to a flowchart illustrated in FIG. 29. Before going into the discussion of the flowchart, when any ink cartridge becomes empty, the display means 70 displays an empty status indication. As the user depresses the cartridge change switch 73 over a predetermined time, accordingly, the carriage control means 72 sends a control signal to the carriage-motor control means 75. As a result, the carriage motor 2 executes a control procedure to move the carriage 1 toward the ink cartridge change window 21 from the home position. When the carriage has reached a position to face the ink cartridge change window 21 and this is confirmed from the information from the encoder 74, the driving of the carriage motor 2 is stopped.

Under this situation, the cartridge fixing lever 51 corresponding to the empty cartridge is lifted to change the ink cartridge, as shown in FIGS. 24 and 25. Then, as the cartridge fixing lever 51 is pressed down as shown in FIG. 26, the new ink cartridge is attached.

Figure 29:
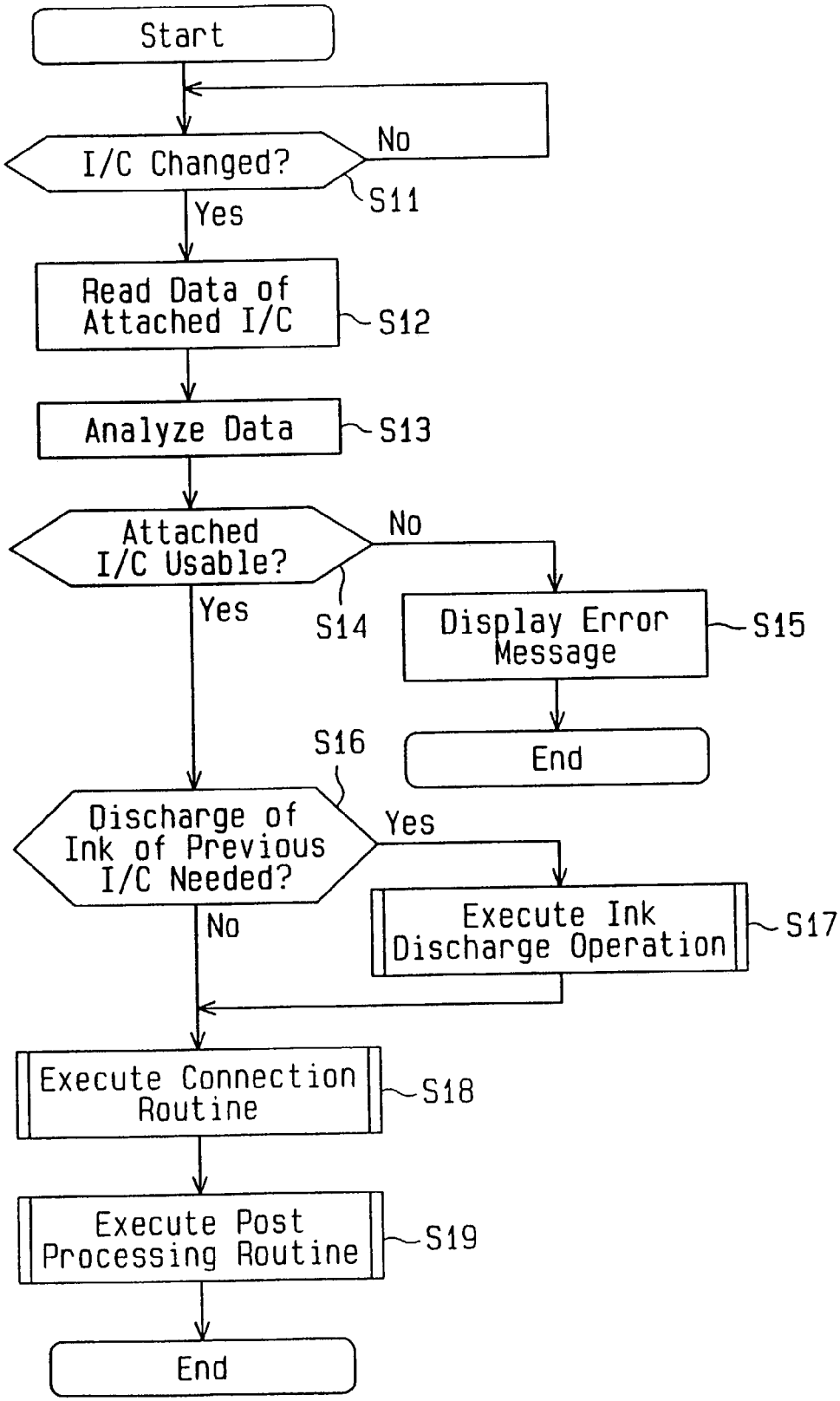
FIG. 29 is a flowchart illustrating a cartridge change control routine, which is executed by the control circuit shown in FIG. 28.

In step S11 shown in FIG. 29, it is detected whether the ink cartridge is attached using a detection signal from the ink-cartridge detection means 76. In the subsequent step S12, reading of data on the attached ink cartridge is executed. This is accomplished as the write/read means 68 reads cartridge information data from the storage device 32 mounted on the attached cartridge as explained with reference to FIG. 28.

In step S13, the cartridge information data is analyzed. This is done by the data analysis means 69, which has received data from the write/read means 68. As indicated in step S14, the data analysis means 69 analyzes (determines) whether or not the attached cartridge is usable. In this case, when it is determined that the period has expired by referring to, for example, the production date (or the usable period) in the cartridge information of the attached cartridge, the cartridge is determined to be unusable (No) in step S14, and the display means 70 displays an error message as indicated in step S15.

In step S14, the type of the ink is also identified so that, even when a color ink cartridge is attached to the holder at which, for example, a black ink cartridge should be attached, the display means 70 likewise displays an error message.

When it is determined in step S14 that the attached ink cartridge is usable, step S16 is performed, where it is determined whether the ink from the previous ink cartridge should be discharged. In this case, when a photo-ink is to be used in place of, for example, a normal ink, it is desirable to attach a photo-ink ink cartridge after, for example, the normal ink previously used is completely discharged. Therefore, an ink discharge operation is carried out as indicated in step S17.

To execute the ink discharge operation, the data analysis means 69 sends a control signal to the carriage control means 72, which in turn sends a command signal to the carriage-motor control means 75 to move the carriage 1 to the home position. Subsequently, an operation is executed to send a control signal from the data analysis means 69 to the cleaning control means 64 to operate the cleaning control means 64 and to discharge the residual ink from the ink flow passage, which extends to the nozzle opening of the printing head 7, by the negative pressure that acts on the capping device 9.

A connection routine illustrated in step S18 is performed following the execution of such an ink discharge operation. In executing the connection routine, the data analysis means 69 sends a control signal to the cam-member drive means 71, thereby rotating the cam member 54 in the direction of the arrow D as shown in FIG. 27. Accordingly, the ink feeding needle 34 that constitutes the ink intake means is connected to the ink feeding port of the cartridge 8, making it ready for the ink to be fed from the cartridge to the printing head.

Then, a post processing routine as shown in step S19 is executed. The post processing routine draws the ink out of the printing head 7 by applying negative pressure to the capping device 9, to feed the ink from the newly attached cartridge to the printing head 7 to fill it. As the routine is executed, the proper printing operation by the printing head is guaranteed.

Although an on-carriage type printing apparatus, which is designed to receive an ink cartridge on the carriage, is given as an example in the above-described embodiment, the invention can be adapted to a printing apparatus of the type in which, for example, an ink cartridge is attached to the cartridge holder of the body of the printing apparatus and the ink is fed to the printing head mounted on the carriage via a flexible ink feeding tube. In this case, the ink intake means including the ink feeding needle 34 shown in FIGS. 23 to 27 is arranged on the cartridge holder on the body of the printing apparatus.

Although the above-described mode gives such an example that an IC memory such as EEPROM is mounted on an ink cartridge as a storage medium, it may be constructed such that a magnetic tape or a bar code or the like is provided instead and cartridge information is read out by a magnetic head or an optical readout device.

The invention claimed is:

1. A removable ink cartridge for an ink-jet type printer comprising:

an ink storage compartment;

a port communicating with the ink storage compartment;

a storage medium for holding information about the removable ink cartridge;

a first terminal connected to the storage medium and disposed on an outer surface of the removable ink cartridge to allow the printer access to the storage medium; and a second terminal connected to the storage medium and disposed on an outer surface of the removable ink cartridge to allow the printer access to the storage medium, wherein the first terminal and the second terminal are spatially separated in a direction of insertion, the first terminal preceding the second terminal in the direction of insertion, and wherein the first terminal and the second terminal are electrically connected in parallel.

2. The removable ink cartridge of claim 1, wherein the first terminal comprises at least two first connections and the second terminal comprises at least two second connections.

3. The removable ink cartridge of claim 2, wherein the at least two first connections and the at least two second connections are respectively electrically connected in parallel.

4. A removable ink cartridge for an ink-jet type printer, comprising:

a first location on the removable ink cartridge, the first location defined by a point at which an initial electrical connection with the printer is made during insertion of the removable ink cartridge;

a second location on the removable ink cartridge defined by a point at which a full mechanical installation of the ink cartridge into the printer is completed;

an ink storage compartment;

a port communicating with the ink storage compartment;

a storage medium for holding information about the removable ink cartridge;

a first terminal connected to the storage medium and disposed on an outer surface of the removable ink cartridge to allow the printer access to the storage medium, and a second terminal connected to the storage medium and disposed on an outer surface of the removable ink cartridge to allow the printer access to the storage medium, wherein the first location and the second location are spatially separated in a direction of insertion, the first location preceding the second location in the direction of insertion, wherein the initial electrical connection is through the first terminal, and wherein the first terminal and the second terminal are electrically connected in parallel.

5. A removable ink cartridge for an ink-jet type printer, comprising:

a first location on the removable ink cartridge, the first location defined by a point at which an initial electrical connection with the printer is made during insertion of the removable ink cartridge;

a second location on the removable ink cartridge defined by a point at which a full mechanical installation of the ink cartridge into the printer is completed;

an ink storage compartment;

a port communicating with the ink storage compartment;

a storage medium for holding information about the removable ink cartridge;

a first terminal connected to the storage medium and disposed on an outer surface of the removable ink cartridge to allow the printer access to the storage medium; and a second terminal connected to the storage medium and disposed on an outer surface of the removable ink cartridge to allow the printer access to the storage medium, wherein the first location and the second location are spatially separated in a direction of insertion, the first location preceding the second location in the direction of insertion, and wherein the first terminal and the second terminal are electrically connected in parallel.

6. The removable ink cartridge of claim 5, wherein the initial electrical connection is through the first terminal, and wherein the second location is further defined by a second electrical connection with the printer through the second terminal.

7. The removable ink cartridge of claim 5, wherein the first terminal comprises at least two first connections and the second terminal comprises at least two second connections.

8. The removable ink cartridge of claim 7, wherein the at least two first connections and the at least two second connections are respectively electrically connected in parallel.

* * * * *